US011719064B2

(12) United States Patent
Løvoll et al.

(10) Patent No.: US 11,719,064 B2
(45) Date of Patent: Aug. 8, 2023

(54) COMPLETING WELLS

(71) Applicant: New Subsea Technology AS, Stavanger (NO)

(72) Inventors: Thor Andre Løvoll, Stavanger (NO); Sigbjørn Madsen, Bru (NO); Bjørn Krossnes Schmidt, Stavanger (NO)

(73) Assignee: New Subsea Technology AS, Stavanger (NO)

( * ) Notice: Subject to any disclaimer, the term of this patent is extended or adjusted under 35 U.S.C. 154(b) by 1 day.

(21) Appl. No.: 17/258,624

(22) PCT Filed: Jul. 10, 2019

(86) PCT No.: PCT/NO2019/050148
§ 371 (c)(1),
(2) Date: Jan. 7, 2021

(87) PCT Pub. No.: WO2020/013706
PCT Pub. Date: Jan. 6, 2020

(65) Prior Publication Data

US 2021/0270104 A1 Sep. 2, 2021

(30) Foreign Application Priority Data

Jul. 12, 2018 (NO) ..... 20180983

(51) Int. Cl.
*E21B 33/035* (2006.01)
*E21B 33/043* (2006.01)

(52) U.S. Cl.
CPC ..... *E21B 33/0355* (2013.01); *E21B 33/043* (2013.01)

(58) Field of Classification Search
CPC ..... E21B 33/043; E21B 33/0355
See application file for complete search history.

(56) References Cited

U.S. PATENT DOCUMENTS 3,638,722 A * 2/1972 Talley, Jr. ..... E21B 33/076 166/338
4,474,236 A 10/1984 Kellet
(Continued)

FOREIGN PATENT DOCUMENTS

EP 1570153 9/2005
GB 1580713 A * 12/1980 ..... E21B 23/06
(Continued)

OTHER PUBLICATIONS

Norwegian Search Report for NO 20180983, dated Feb. 6, 2019.
International Search Report and the Written Opinion for PCT/NO2019/050148, dated Nov. 18, 2019.

*Primary Examiner* — Aaron L Lembo
(74) *Attorney, Agent, or Firm* — Andrus Intellectual Property Law, LLP

(57) ABSTRACT

A well has an outer housing with a vertical main bore and a wing bore. The well is completed by: running an upper completion into the well; locating a tubing hanger in the main bore of the outer housing for fluid communication with the wing bore, the tubing hanger including a services line connected to downhole equipment; connecting a further services line to the services line of the tubing hanger, after the tubing hanger has obtained said operational position; and installing a cap on an end of the main bore. The connected services lines are arranged to communicate a service between the tubing hanger and an exterior of the capped well through either or both of: the end of the main bore; and the cap. Related apparatus, a cap, and a tubing hanger are also described.

21 Claims, 18 Drawing Sheets

(56) References Cited

U.S. PATENT DOCUMENTS 5,107,931 A * 4/1992 Valka ..... E21B 33/038 405/195.1
5,992,526 A * 11/1999 Cunningham ..... E21B 33/035 166/356
6,494,257 B2 12/2002 Bartlett et al.
7,025,132 B2 4/2006 Kent et al.
8,485,262 B1 * 7/2013 Angers ..... E21B 33/043 166/85.1
8,596,608 B2 * 12/2013 Grimseth ..... E21B 33/0355 251/74
11,421,501 B2 * 8/2022 Murphy ..... E21B 33/0415
2003/0150620 A1 * 8/2003 DeBerry ..... E21B 33/043 166/88.4
2004/0099419 A1 * 5/2004 Skeels ..... E21B 34/10 166/321
2004/0104024 A1 6/2004 Kent et al.
2004/0112604 A1 * 6/2004 Milberger ..... E21B 33/043 166/88.1
2004/0262010 A1 * 12/2004 Milberger ..... E21B 33/043 166/368
2008/0190621 A1 * 8/2008 Huang ..... E21B 33/037 166/341
2009/0211761 A1 8/2009 Broussard
2013/0249210 A1 * 9/2013 Haddox ..... F16L 37/002 285/305
2016/0258247 A1 * 9/2016 Christie ..... E21B 33/043
2016/0305232 A1 * 10/2016 Bird ..... E21B 47/001
2020/0248522 A1 * 8/2020 Rivlin ..... E21B 33/038

FOREIGN PATENT DOCUMENTS

GB 2319544 5/1998
GB 2397312 A * 7/2004 ..... E21B 33/035
WO 8601852 3/1986
WO 0047864 8/2000

* cited by examiner

COMPLETING WELLS

CROSS-REFERENCE TO RELATED APPLICATIONS

This application is the U.S. national stage application of International Application No. PCT/NO2019/050148, filed Jul. 10, 2019, which international application was published on Jan. 16, 2020, as International Publication WO 2020/013706 in the English language. The International Application claims priority of Norwegian Patent Application No. 20180983, filed Jul. 12, 2018. The international application and Norwegian application are both incorporated herein by reference, in entirety.

FIELD

The present invention relates in particular to the completion of wells.

BACKGROUND

In the oil and gas exploration and production industry, wells extend deep into the earth's subsurface for extracting hydrocarbons. The construction of the well generally includes drilling a borehole. After a section of the borehole is drilled it may be cased or lined by one or more lengths of casing or lining for stabilising and preventing collapse of formation material into the drilled hole. Another section of the borehole may then be drilled by running the drill string through the cased section, and this other section may thereafter also be cased or lined. The wellbore can thus be constructed section-by-section until the wellbore extends to the required depth within the earth, and in the case of a production well, penetrates the reservoir from which hydrocarbons are to be extracted and produced from the well. Completion operations such as setting a screen and installing tubing, e.g. production or injection tubing, may then take place.

The tubing may be installed to transmit fluid through the wellbore during operation of the well. In the case of production, production fluid comprising hydrocarbons from the reservoir formation is transmitted through production tubing upward through the wellbore. The top end of the tubing is typically connected to a tubing hanger. The tubing hanger is typically landed on a profile in a structure at the upper end of the well.

The tubing, especially those sections of the tubing that are intended to be placed in the reservoir interval, may include sensors, e.g. for measuring temperature or pressure, "inflow" or "outflow" valves—operable for allowing inflow into or outflow of fluid from the formation—, and/or other equipment or instrumentation for use in the wellbore.

In order to communicate with the downhole equipment or instruments, services lines may be established on the tubing. These may provide the downhole equipment or instruments with desired electrical, hydraulic, and/or optical services, such as data, signals, and/or power transmission for operating or communicating with the equipment or instruments.

Wells can be completed to establish a path for extracting production fluid in various ways. For example, in a horizontal valve tree such as often employed subsea, the tubing hanger is landed on a profile in a vertical main bore of the tree. In the operational phase, production fluid exiting from the top of the wellbore may then be directed through an internal central bore in the tubing hanger and onward through a wing bore of the valve tree for downstream processing. Before production takes place, plugs are run into the tree and set in place to plug the bore in the tubing hanger. A pressure containment cap may then typically be fitted to the tree, in another run, at the top end of the main vertical bore of the tree.

In order to obtain fluid communication with the wing bore, the tubing hanger typically has an internal bore with a side port, such that when the tubing hanger is landed the side opening may align with the wing bore and fluid may flow between the internal bore of the tubing hanger and the wing bore.

In some cases, services lines on the tubing run from the downhole equipment or instruments and connect to the lower end of the tubing hanger. The tubing hanger in such a case can facilitate connection between a downhole services line on the tubing and a connector on an exterior of the well available for an external unit to connect for communication with and/or operation of the downhole equipment.

Solutions have been proposed that seek to orient and locate the tubing hanger in a specific orientation within the tree once it has landed where the side port is aligned with the production wing bore and/or where services communication with an exterior connector in the side of the body of the tree is obtained. Examples include using a spiral profile on the outside of the tubing hanger or on an inner wall of the vertical bore of the tree so that the tubing hanger is guided into correct orientation with respect to the tree, following the trajectory of the spiral, as it is lowered into place in the tree.

The solutions above may suffer certain drawbacks. The tubing hanger with tubing attached is generally a large and cumbersome structure and orienting such a structure may require significant complexity in the system design to account for its sizable nature. In particular, sufficient height in the main bore may be needed for providing a spiral profile at a suitable pitch in order to guide the tubing hanger and connected tubing into place. The height can be a significant issue, because increased height above the seabed can affect structural tolerances, e.g. increase susceptibility to bending moments, and reduce expected fatigue life. In addition, required materials for large structures and performance specifications required of such materials and structures may have high costs, especially in subsea wells. This in turn can have a negative knock-on effect upon requirements and performance required from other components and materials of such components in the completed well. The provision of a spiral guide profile can also undesirably occupy radial space in the bore of the tree. This can limit the maximum size of equipment that can pass through the spiral. The arrangement of the tubing hanger may not allow external communication with services on the tubing before located in position using the tubing hanger running tool. Conventional procedures for completing the well may also suffer from multiple runs or deployments to obtain the connections, alignment, and completion ready for production or injection.

SUMMARY

It is an aim of the invention to obviate or at least mitigate one or more drawbacks of the prior art.

Various aspects of the invention are set out in the claims appended hereto.

Any of the various aspects of the invention may include further features as described in relation to any other aspect, wherever described herein. Features described in one embodiment may be combined in other embodiments. For example, a selected feature from a first embodiment that is compatible with the arrangement in a second embodiment may be employed, e.g. as an additional, alternative or optional feature, e.g. inserted or exchanged for a similar or like feature, in the second embodiment to perform (in the second embodiment) in the same or corresponding manner as it does in the first embodiment.

Various further advantages of the embodiments of the invention and its features are described and will be apparent from the specification throughout.

BRIEF DESCRIPTION OF THE DRAWINGS

There will now be described, by way of example only, embodiments of the invention with reference to the accompanying drawings, in which.

DETAILED DESCRIPTION OF THE DRAWINGS

Figure 1:
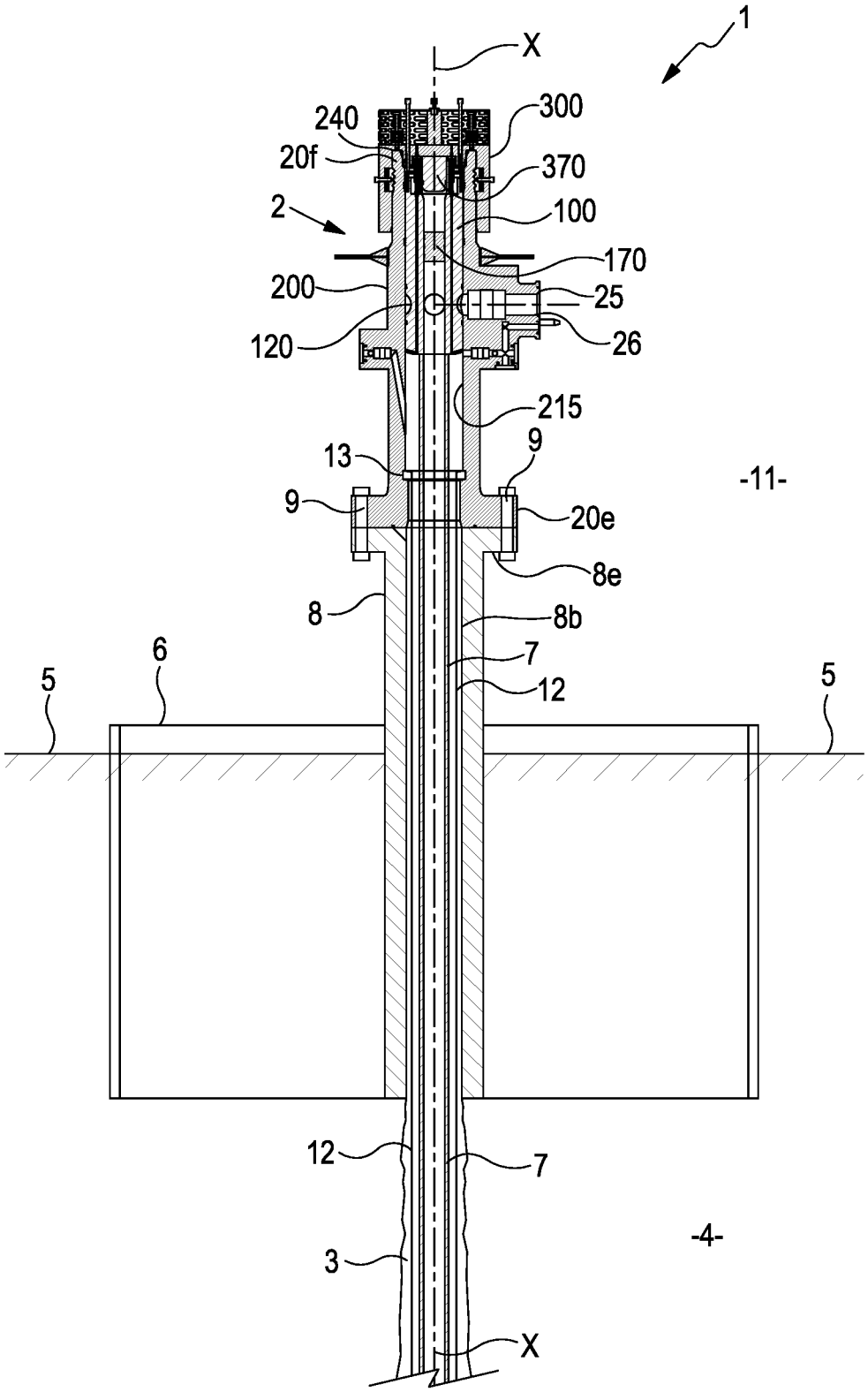
FIG. 1 is a schematic representation of a well in location subsea and completed for production, including apparatus for completing the well, according to an embodiment of the invention.

In FIG. 1, there is depicted a subsea well 1 which has been completed using apparatus 2 for completing the well. The well 1 includes a wellbore 3 which penetrates into the geological subsurface 4 beneath the seabed 5. In this example, the well 1 is a hydrocarbon production well. As such, the configuration shown in FIG. 1 is completed with production tubing 7.

The apparatus 2 comprises an outer housing 200 that extends upward from the seabed 5. A tubing hanger 100 is housed within a vertical main bore 215 of the outer housing 200. The production tubing 7 is connected to a lower end of the tubing hanger 100. A surface of the tubing hanger 100 engages a corresponding surface of a profile protruding inwardly from a wall of the bore 215. The tubing hanger 100 thus sits in place on the profile, supporting the tubing 7 such that it is suspended in the wellbore 3 from the hanger 100.

It can also be noted with reference to FIG. 1 that the well 1 has a foundation 6 that penetrates and serves to provide anchorage at the seabed 5. A tubular spool 8 is integrated or connected to the foundation 6 and extends upward into the sea above the seabed 5. The outer housing 200 is in turn supported end to end on the spool 8. The upper end **8*e* of the spool is connected to a lower end 20*e* of the housing. The upper end 8*e* of the spool 8 and the lower end 20*e* of the tubular body 20 have flanges and end surfaces of their respective ends 8*e*, 20*e* are juxtaposed against one another. The flanges are joined by mechanical fasteners 9, e.g. threaded bolts, clamps, or any other suitable fastener, and the main housing 20 is thereby connected to the spool 8. The foundation 6 supports and stabilises the apparatus 2, especially as against lateral forces that are imparted to the outer housing 200 and/or other structure of the well 1 rising from the seabed 5**.

During earlier phases of construction and completion of the well 1, equipment such as drill string, casing, lining, production screens, and tubing are run into the subsurface through a bore **8*b* of the spool 8. The foundation 6 and spool 8 are therefore some of the first components to be installed at the desired well location on the seabed 5. In addition, the outer housing 200 is connected to the spool 8 and installed together with the foundation. Subsequent operations of drilling, casing lining, setting screens, and running tubing are therefore performed with the main housing 200 already in place. The mechanical fastening of the main housing 200 to the spool can therefore be performed onshore, before deployment. A unit comprising the main housing 200, the spool 8, and the foundation 6 can then conveniently be lowered through the sea 11 into the indicated position on the seabed 5. The foundation 6** in this example is a suction anchor in the form of an upside-down bucket.

The well 1 can in general be completed with several casings and the outer housing 200 can thus in practice include several casing hanger profiles in the bore 215, although only one such profile 13 is shown in FIG. 1 for purposes of clarity. The casing 12 is suspended and cemented in place in the subsurface from the profile 13. In practice, the casing 12 or any other casing, has a corresponding casing hanger that is connected in conventional manner to the upper end of the casing 12 and rests against a surface of the casing hanger profile 13. Again, for purposes of clarity, the casing hanger(s) are not shown in the drawings.

Also, still referring to FIG. 1, a cap 300 is disposed on an upper end 20*f* of the main housing 200. The tubing hanger 100 has a production outlet 120 which communicates with a wing bore 26 of a production wing 25 of the tubular housing 200. Above the production outlet 120, a first plug 170 is disposed in a central longitudinal throughbore of the tubing hanger 100, and the cap 300 includes a second plug 370 which, with the cap 300 in place, is also disposed in the central bore of the tubing hanger 100, at a location above the first plug 170.

In the completed configuration of FIG. 1 therefore, the apparatus 2 is arranged so that the well 1 is ready to communicate production fluid through the production tubing 7, though the production outlet 120 of the tubing hanger 100, and through the wing bore 26 of the outer housing for downstream processing. In practice, the production fluid is transmitted on a flow path through well control equipment (not shown), e.g. a well choke, and/or flow valves or the like, which is typically connected to the production wing 25, onward to a production flow line.

Figure 2:
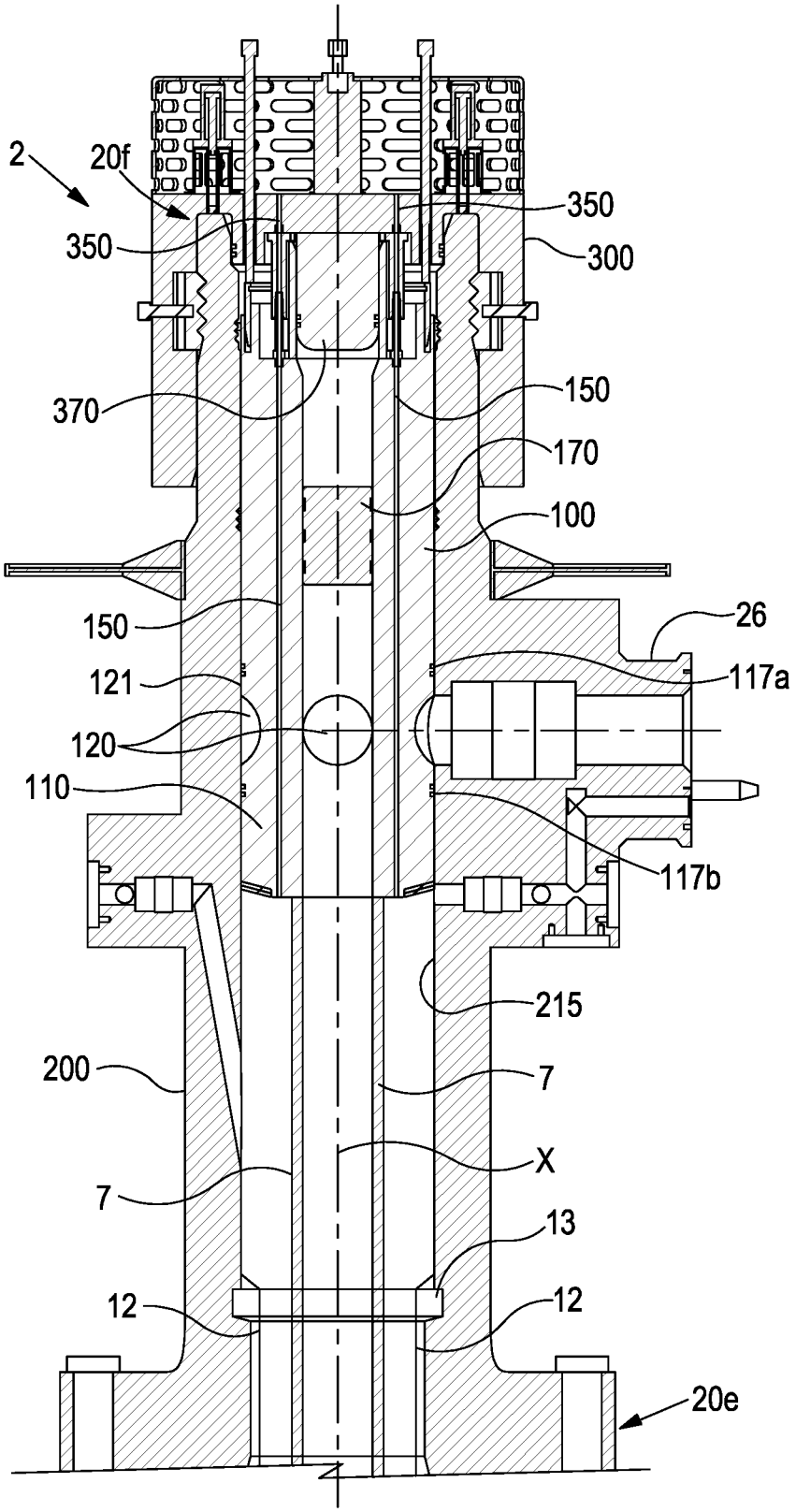
FIG. 2 is a side sectional representation of the apparatus for completing the well of FIG. 1 in larger scale.

In FIG. 2, the wellhead apparatus 2 is depicted in greater detail with the tubing hanger 100 inserted inside the outer housing 200, and with the cap 300 connected securely to the upper end 20*f* of a tubular portion of the housing 200.

The production tubing 7 has typically downhole equipment or instruments (not shown), e.g. valves or sensors which require to be controlled and/or communicate with external facilities or equipment. To this end, services lines for providing electrical, hydraulic, or optical services are provided, running through the tubing hanger and the connected cap. External units e.g. control lines, jumpers, etc., can be connected to connectors on the cap for communicating with downhole equipment via the services lines in the apparatus 2. This will be described in further detail below.

Notably, the tubing hanger 100 is non-directional in that it in principle can be installed and housed within the tubular housing 200 in any rotational orientation, yet still obtain the necessary fluid communication between the production outlet 120 and the wing bore 26. The cap 300 is directional and needs to be lined up in a specific, aligned rotational configuration with respect to the tubing hanger before it can be attached, in this example, through axial translation of the cap 300 along central longitudinal axis X. Services lines in the cap 300 and tubing hanger 100 connect via respective pairs of connectors in male-female relationship through an axial action which is obtained by the axial translation of the cap.

The apparatus 2 is configured to allow the necessary rotational positioning of the cap and alignment to be achieved. This is also described in more detail in the following.

Figure 3:
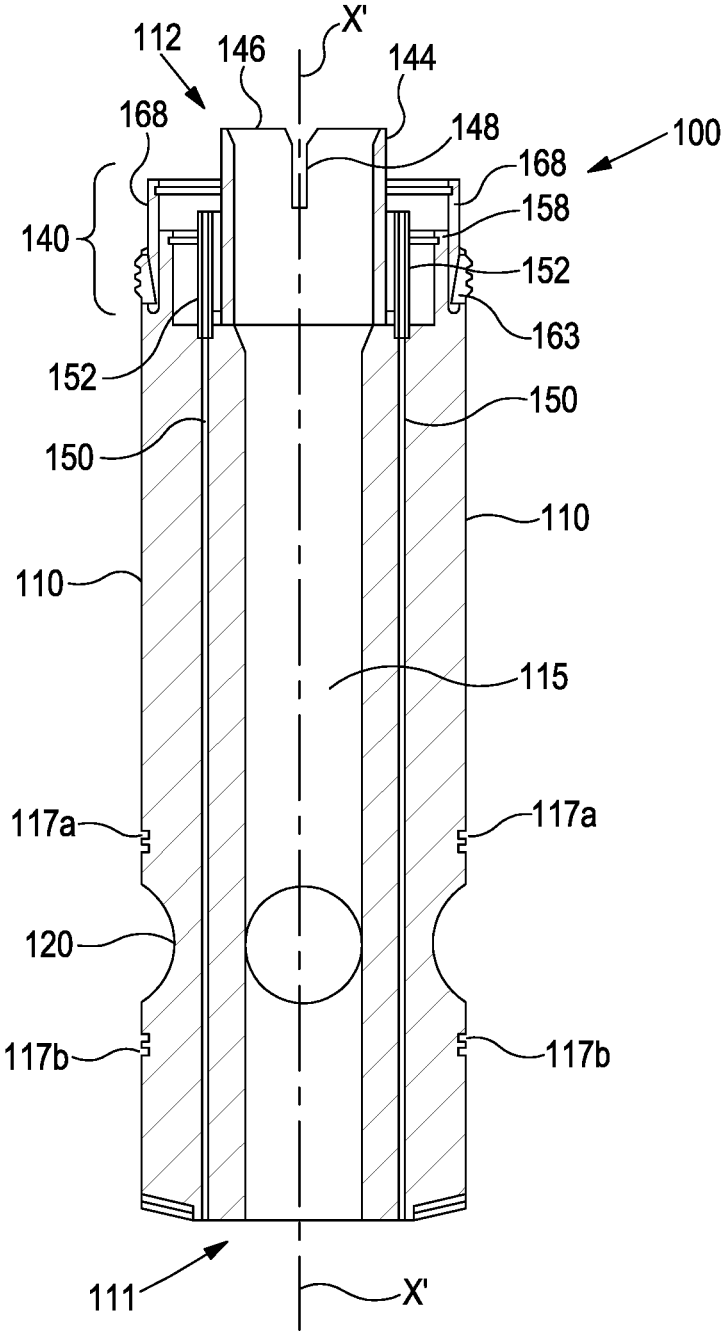
FIG. 3 is a side sectional representation of the tubing hanger of the apparatus of FIGS. 1 and 2, in still larger scale.
Figure 4:
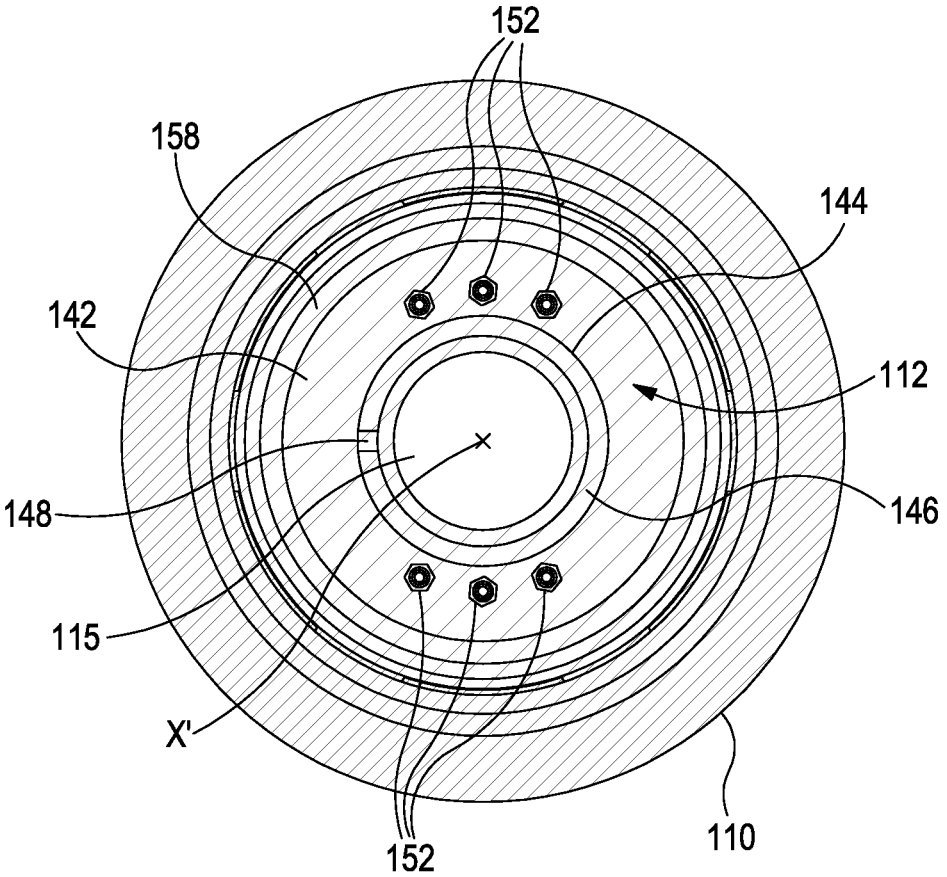
FIG. 4 is a top view representation of the tubing hanger of FIG. 3 in larger scale.
Figure 5:
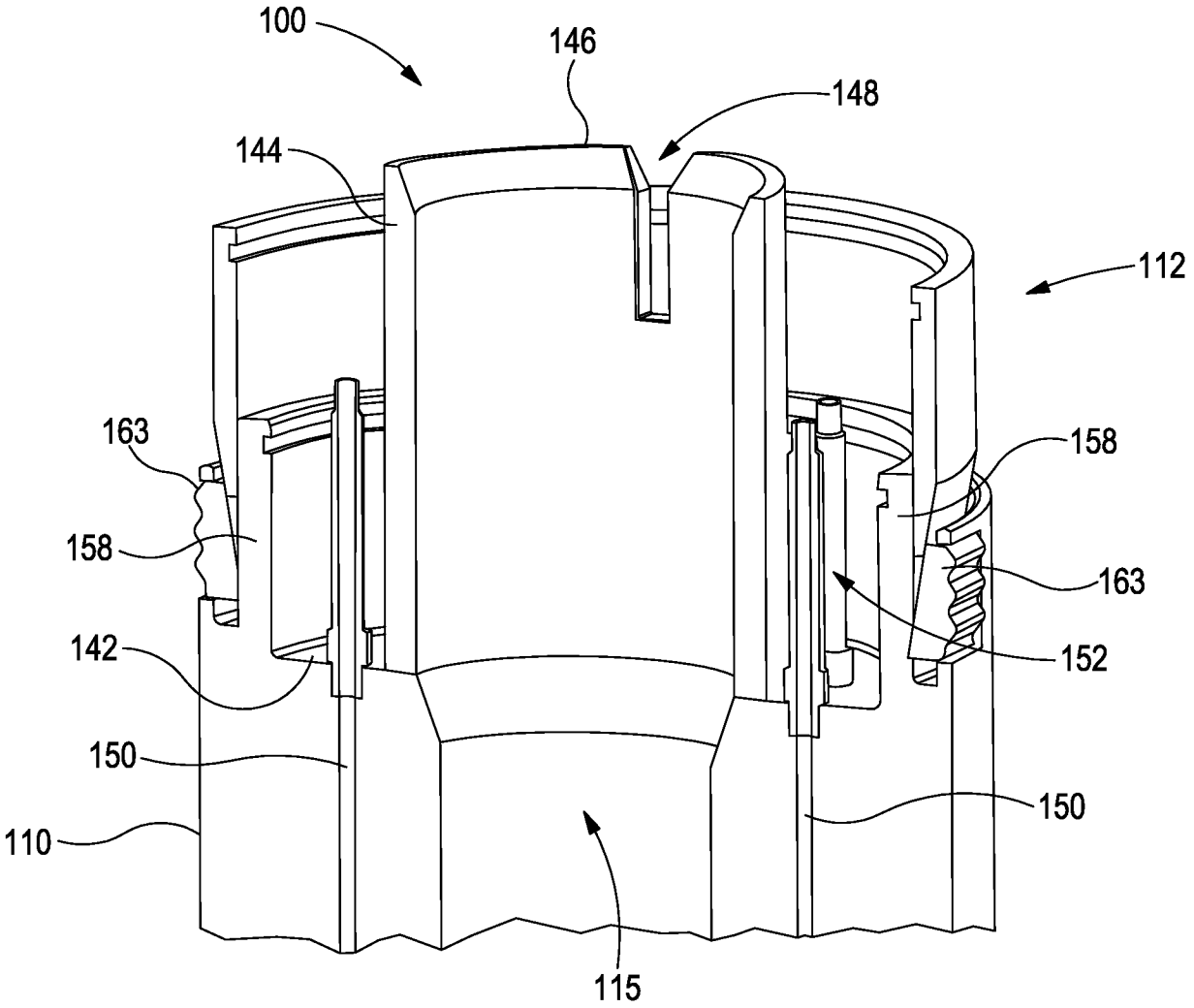
FIG. 5 is a simplified perspective representation of an upper portion of the tubing hanger of FIGS. 3 and 4 in another scale.
Figure 6:
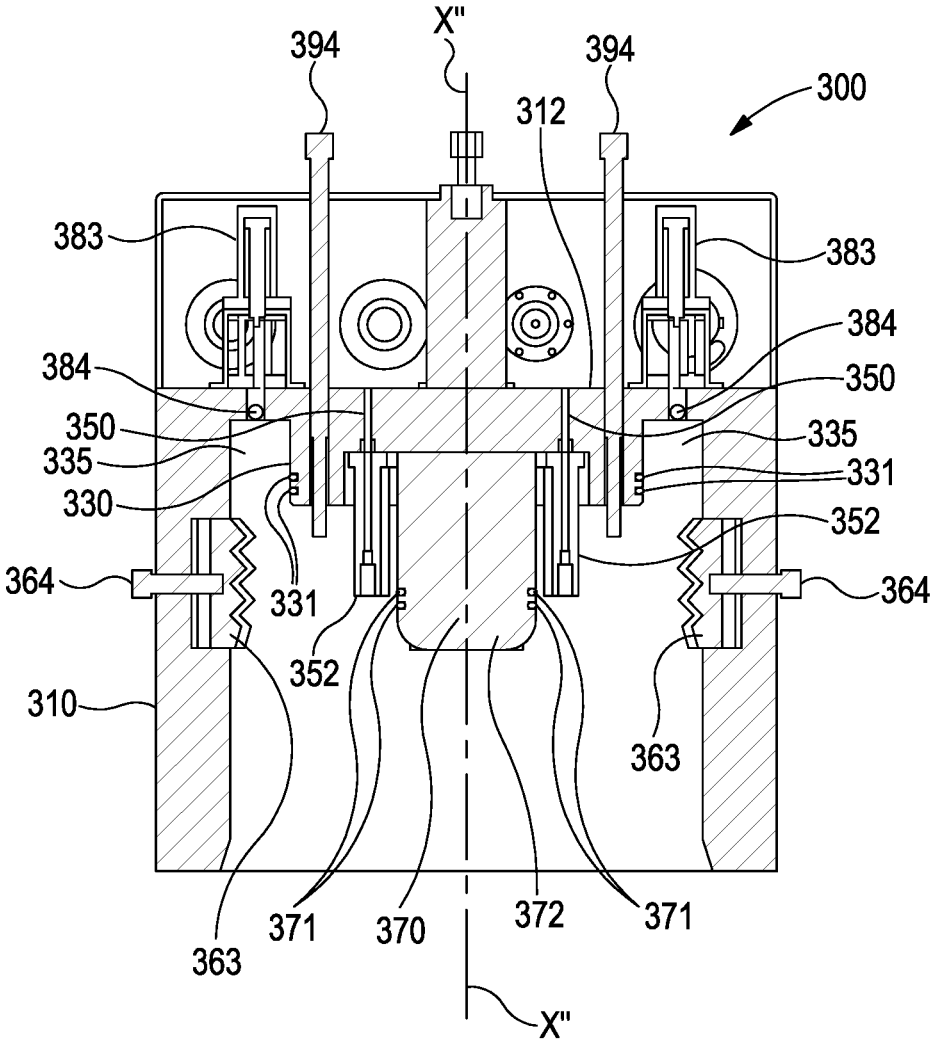
FIG. 6 is a side sectional representation of the cap of the apparatus of FIG. 1 in larger scale.
Figure 7:
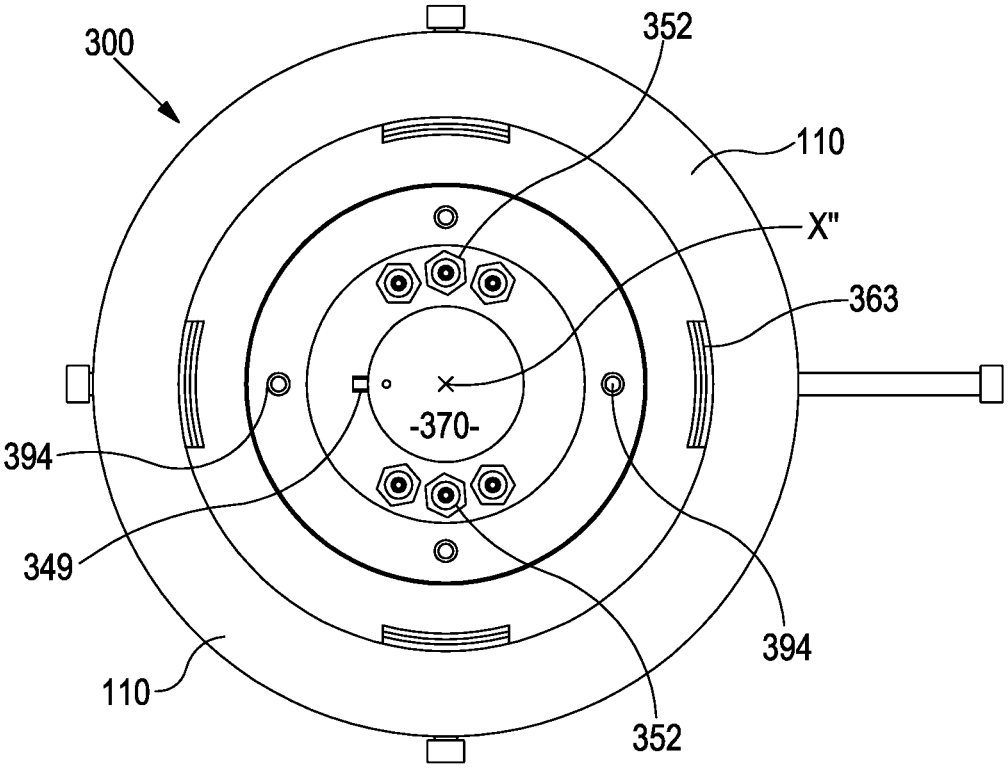
FIG. 7 is a bottom view representation of the cap of FIG. 6 in still larger scale.
Figure 8:
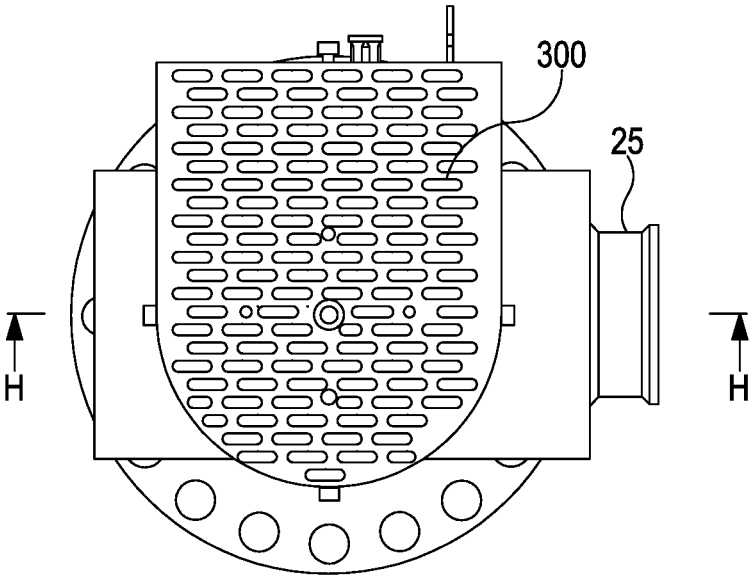
FIG. 8 is a top view representation of the cap of FIG. 6 in smaller scale.
Figure 9:
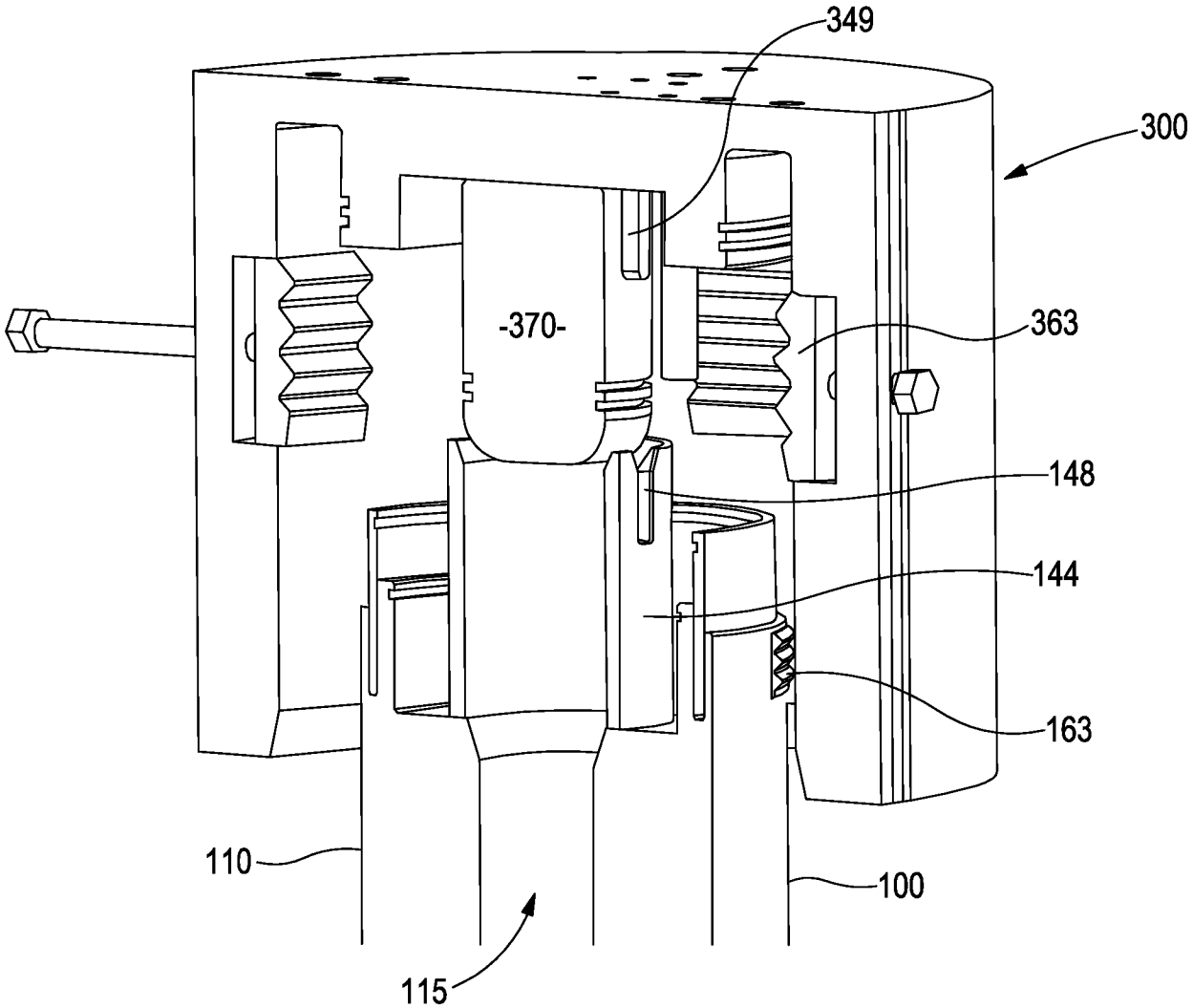
FIG. 9 is a simplified perspective representation of the cap of FIGS. 6 to 8 and the tubing hanger of FIGS. 3 to 5 showing selected interior detail in another scale.

Referring first then additionally to FIGS. 3 to 5, the tubing hanger 100 is described in more detail and as can be seen has a cylindrical elongate body 110 extending from a first, lower end 111 (in use) to a second, upper end 112 of the hanger 100 (in use). A central bore 115 runs end to end through the body 110 with central axis X' extending longitudinally therethrough. The bore 115 is normally open when running the tubing 7 into the well 1. Note however that the central bore 115 may have a temporary sleeve (not shown) inserted during run in to isolate radially the production outlet 120 from the bore 115. This can allow for fluid to be circulated in the wellbore through the tubing during run-in.

In order to communicate services to downhole equipment or instruments, services lines 150 run through the body 110 from the first end 111 to the second end 112. The services lines 150 are for example conduits in the material of the wall of the tubing hanger 100 that can transmit hydraulic fluid for downhole equipment or instruments through the tubing hanger. In other variants, one or more services line 150 can be electrical or optical fibre line(s).

At the upper end 112, the hanger 100 includes services line connectors 152 which provide upper terminations for the services lines 150. The services line connectors 152 of the tubing hanger 100 are conventional male connectors that are arranged to penetrate corresponding female connectors carried on the cap 300. Each comprises an elongate penetrating member that extends axially in parallel with the central long axis X'. The connectors 152 protrude from an end surface 142 of the body 110 and are spaced apart on the end surface 142 in different rotational positions on a circle around the axis X'.

The service line connectors 152 are arranged so that connection is obtained with corresponding female connectors by axial movement of the male connector into a receiving socket of the female connector.

At the lower end 111 of the tubing hanger 100, the service line sections 150 pass from the lower end into connected further service line sections on the tubing 7 below the tubing hanger (not shown). These are connected in turn to downhole equipment or instrumentation which, once the well is completed, can be positioned deep in the wellbore such as at the reservoir interval.

The tubing hanger 100 is to be run in and positioned inside the outer housing 200 without the cap 300 installed. The services line connectors 152 are therefore initially disconnected, as indicated in FIGS. 3 to 5, from their corresponding connectors of the cap. Upon subsequent installation of the cap 300, a services line connection is sought from the service line connectors 152. The upper portion 140 of the tubing hanger 100 is therefore arranged also to facilitate aligning corresponding connectors in the cap 300 with the services line connectors 152 of the tubing hanger 100.

Typically, the connectors 152 provide hydraulic, electrical, or optical communication through the connection, e.g. for data or power transmission for use and/or operation of downhole equipment or instruments.

The apparatus 2 includes a guide arrangement for maintaining correct, desired position of the cap 300 relative to the tubing hanger 100 as the cap is lowered into place to connect the services lines 150, 350. The guide arrangement can be implemented in various ways.

In this example, the guide arrangement includes a locating member 349 and a receiving slot 148 in a wall of a sleeve which in this case is exemplified as being an inner end sleeve 144 in the upper portion 140 of the tubing hanger 100. The locating member 349 keys into the slot 148 when in the correct orientation of cap 300 relative to the tubing hanger 100. With the locating member in the slot 148, the locating member follows the trajectory of the slot 148 as the cap is lowered into position, such that the movement of the cap 300 is constrained according to the slot trajectory.

The tubing hanger 100 thus permits the cap 300 to be moved axially for obtaining connection to the connectors 152 only in a specific, aligned rotational position with respect to the tubing hanger.

In this example, the inner end sleeve 144 extends longitudinally from the end surface 142 at the uphole end. The inner end sleeve 144 has guide slot 148 which extends along the surface from a leading surface 146 of the sleeve and is arranged to receive and cooperate with a corresponding locating member of the cap once the cap is rotated into aligned position. When in the guide slot 148, the locating member 349 of the cap follows the trajectory of the slot 148, axially, permitting only axial translation of the cap relative to the tubing hanger and main tubular body. The axial movement enables the connectors to connect through corresponding axial action.

The end 112 of the tubing hanger 100 has an outer wall 158 circumferentially around the inner end sleeve 148. The service line connectors 152 protrude into an annular region defined between the inner end sleeve and the outer wall. Locking dogs 163 are arranged on an outside of the outer wall 158 and a locking sleeve 168 is slidably disposed around the outer wall 158 for locking the locking dogs 163 outwardly against the outer housing 200. The locking sleeve 168 has a tapered lower edge. By axial movement of the sleeve 168 in the downhole direction, the tapered edge forms a wedge between the outer wall 158 and a rear surface of the locking dogs. In this way, the locking dogs 163 are forced outward.

The tubing hanger also has annular seals 117*a*, 117*b* around an outside of the body 110 on either side of the production outlet 120. The annular seals 117*a*, 117*b* are arranged to seal between the body and the surrounding wall of the outer housing 200 to define an annular chamber 121 (see e.g. FIG. 2) around the body 110 for fluid from the production tubing to flow from the central bore 115 of the tubing hanger and communicate into the production wing bore 26 regardless of its rotational angle about the axis X within the outer housing.

Turning now to refer additionally to FIGS. 6 to 9, the cap 300 is described in more detail. The cap 300 has an end wall 312 and cylindrical side walling 310 that depends from the end wall 312, around central axis of the cap X". The cap is thus configured to fit over an upper end 22*f* of a tubular portion of the main housing 200 of the outer housing 2, the side walling 310 overlapping the end 22*f*. The cap 300 is configured contain fluid pressures in the main bore which may be exposed to the pressure from the wellbore when in use.

On an inside of the cap 300, the cap 300 includes services line connectors 352 which provide terminations to services lines 350. The services line connectors 352 of the cap are arranged to connect with the services line connectors 152 of the tubing hanger. The services line connectors 352 are the female counterparts to the male connectors 152 of the tubing hanger 100. The services lines 350 in the cap penetrate through the end wall 312 and run to an exterior connector, which may in turn be plugged to an external unit or module, or jumper line (not shown) to which an operator may connect from an external facility e.g. to send data and receive data from downhole equipment via the service line e.g. for controlling the well.

The cap 300 includes a central plug 370 which is adapted to be inserted and received sealingly inside the bore 115 of the tubing hanger, in this case inside the inner end sleeve 144 of the tubing hanger. When so received in the tubing hanger and the cap 300 is fitted, the plug 370 occludes and plugs the central bore of the tubing hanger 100 in pressure sealing manner. To this end, the plug has seals 371, e.g. elastomer ring seals, around an outer circumference of an occluding body 372 of the plug. The seals 371 are arranged to seal between the occluding body 372 and an inner surface of the sleeve 114. This plug 370 on the cap 300 can be used to provide an independent second barrier against wellbore pressure in the central bore, e.g. to satisfy compliance requirements.

In order to provide pressure containment, the cap 300 also includes seals 331 for fluid and pressure-tight sealing between the cap 100 and the outer housing 200. The seals 331 are ring seals disposed circumferentially around an outer surface of a central boss 330 which depends internally from the end wall 312 of the cap 300. An annular region 335 is defined between the outer surface of the boss 330 and the side walling 310 of the cap 300 for receiving the tubular end portion of the main housing 200 therein. The outer diameter of the boss 330 therefore matches the diameter of main bore 215 of the outer housing to provide tight, sliding fit for the boss 330 into the end of the bore 215 of the outer housing 200. The seals 331 ensure that any micro-space between the boss 330 and the adjacent surface of outer housing housing is pressure tight once the cap is fully lowered and fitted to the outer housing 200 and the end 20*f* of the outer housing 200 is fully received in the annular region 335.

The cap 300 further includes locking dogs 363 that are arranged to be engaged against an outer surface of the end 22*f* of the outer housing 200 to lock the cap 300 with respect to the outer housing 200. The locking dogs 363 are spring biased radially inwardly. The locking dogs 363 locate in a corresponding profile on an outside of the tubular portion of the outer housing 200 when being fitted. A first set of securing pins 364 are screwed through the side walling 310 of the cap against the rear of the locking dogs 363. This can prevent the locking dogs 363 from inadvertently releasing and can avoid accidental dislodgement of the cap e.g. due to spurious pressure build up or the like inside the apparatus apparatus after the cap is installed.

The cap 300 is further provided with a second set of securing pins 394 which are screw threaded to the end wall 312. These securing pins 394 can then be extended axially into the interior of the cap and against the upper end of the locking sleeve 168 of the tubing hanger. The end of the securing pins 394 provide a mechanical obstruction that prevents the locking sleeve 168 from moving relative to cap. This helps to secure the locking sleeve 168 against inadvertent dislodgement of the dogs 163 under wellbore pressures.

The locking dogs 363 may in other variants be hydraulically or electrically actuated (e.g. by use of a remote manipulator) to connect and secure the cap 300 to the outer housing 200. Hydraulic or electric actuation mechanisms may also be used for securing the locking dogs 168 of the tubing hanger 100 against the outer housing 200. For example, the pins 364, 394 could be hydraulically or electrically operated to move into their indicated positions for securing the dogs 163, 363 instead of the screw thread mechanisms.

Furthermore, the cap 300 has retractable landers in the form of actuators 383. The actuators 383 have arms which can be extended for purposes of landing the cap 300 on a landing surface of the wellbore apparatus, more specifically in this example the landing surface being an end surface 240 of the outer housing 200. Once landed, the extended actuators 383 can be retracted in a subsequent installation step for lowering the cap axially into full cooperation and fully fitted position on the end of the housing 200. The operation of the actuators 383 may be hydraulic, in which case the actuators 383 may include hydraulic cylinders that are actuated to extend or retract the arm. The landers could in other variants be electrically operated to retract and extend. The arms have rollers 384 provided on their ends for supporting the cap 300 on the end surface 240 of the outer housing 200 when landed. The rollers 384 are arranged to roll on the landing surface 240 and facilitate rotation of the cap 300 with respect to the housing when landed.

The cap 300 in this example includes the locating member 349 of the guide arrangement. The locating member 349 which is configured to locate in the guide slot 148 of the tubing hanger 100 once appropriately aligned. The locating member 349 is in the form of a pin extending axially in the interior of the cap away from the end wall 349. Moreover, the locating member 349 is arranged so as to be positioned a radial distance away from the central axis corresponding to the location of the end sleeve 144 of the tubing hanger. Depending on its rotational position about the axis X', X, the locating member 349 can be moved into the slot 148. Otherwise, in non-aligned rotational positions, it may abut an end surface 146 on the sleeve 144 to block axial movement of the cap 300 onto the housing 200. The locating member 349 in this example is disposed on an outside of the occluding body 372, dimensioned to provide a tight but slidable fit in the slot 158 that allows axial movement but prevents lateral or rotational movement about the axis for providing a suitable, well constrained trajectory for the connectors 152, 352 to be connected.

Figure 11:
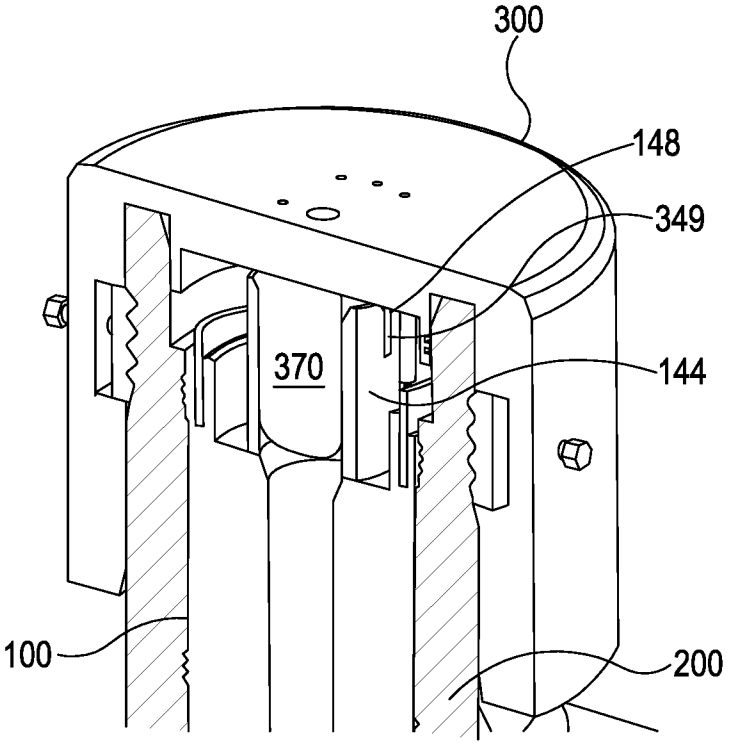
FIG. 11 is a simplified perspective representation of the cap of FIGS. 6 to 8 and the tubing hanger of FIGS. 3 to 5 showing selected interior detail in a further position, in a smaller scale.
Figure 10:
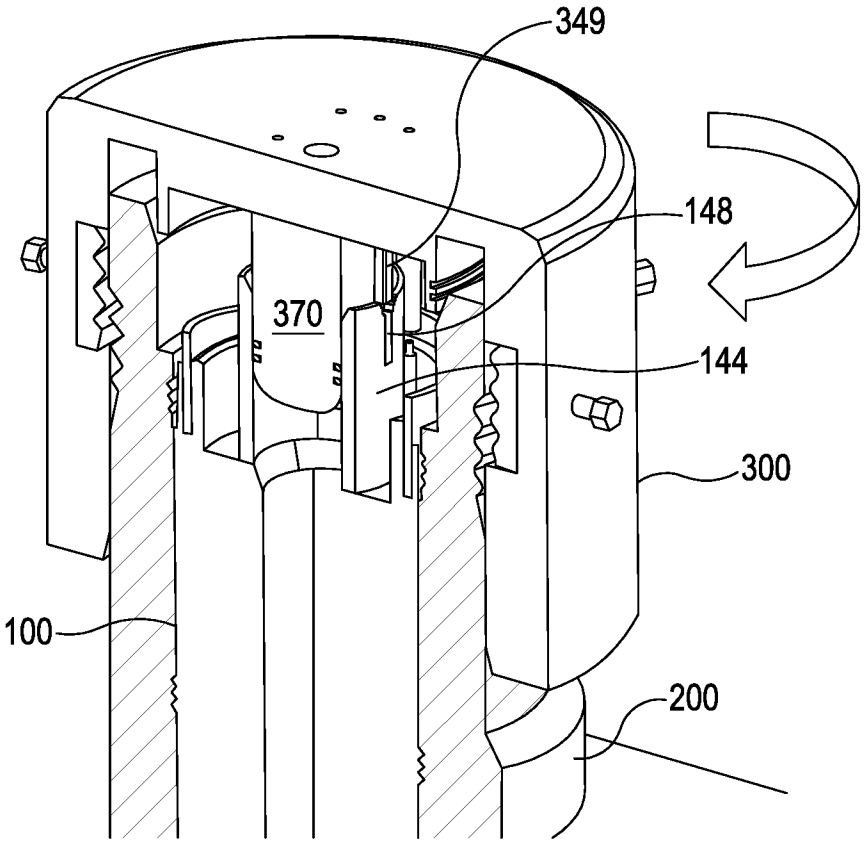
FIG. 10 is a simplified perspective representation of the cap of FIGS. 6 to 8 and the tubing hanger of FIGS. 3 to 5 showing selected interior detail in an aligned position, in a smaller scale.

As will be further appreciated with reference to FIGS. 10 and 11, the alignment principle for aligning the cap 300 with respect to tubing hanger 100 to allow connection of the connectors 152, 352 is based on landing the cap 300, rotating the landed cap 300 to the aligned position generally shown in FIG. 10, then once the correct alignment is found, moving the cap 300 axially along the main bore 215 onto the end of the housing 200 under guidance of the guide slot 158, thereby connecting the respective pairs of service line connectors 152, 352.

Figure 12:
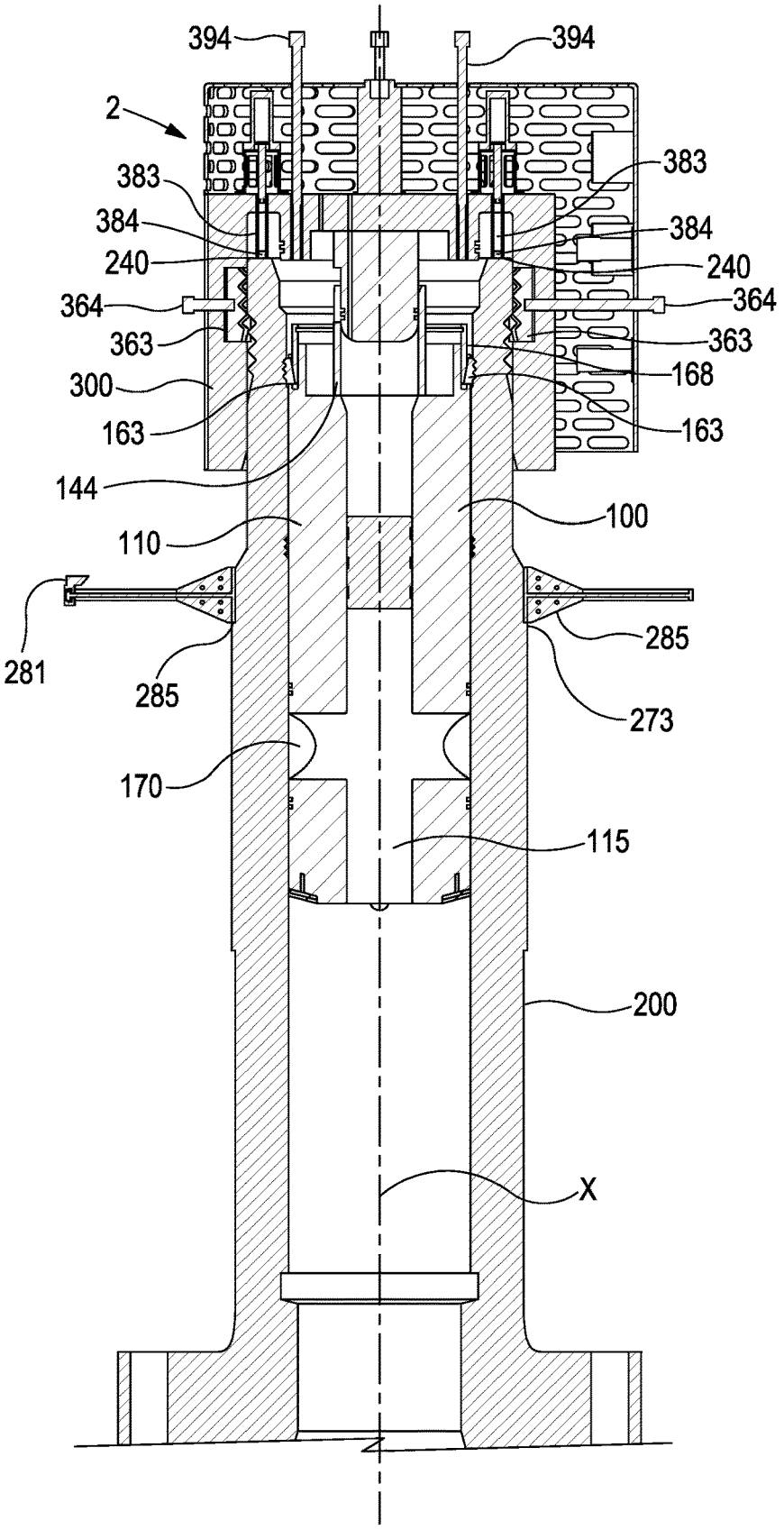
FIG. 12 is a side sectional representation of the apparatus for completing the well of FIGS. 1 and 2 in a perpendicular direction and in large scale, with the cap arranged in an initial landed position, during installation.
Figure 13:
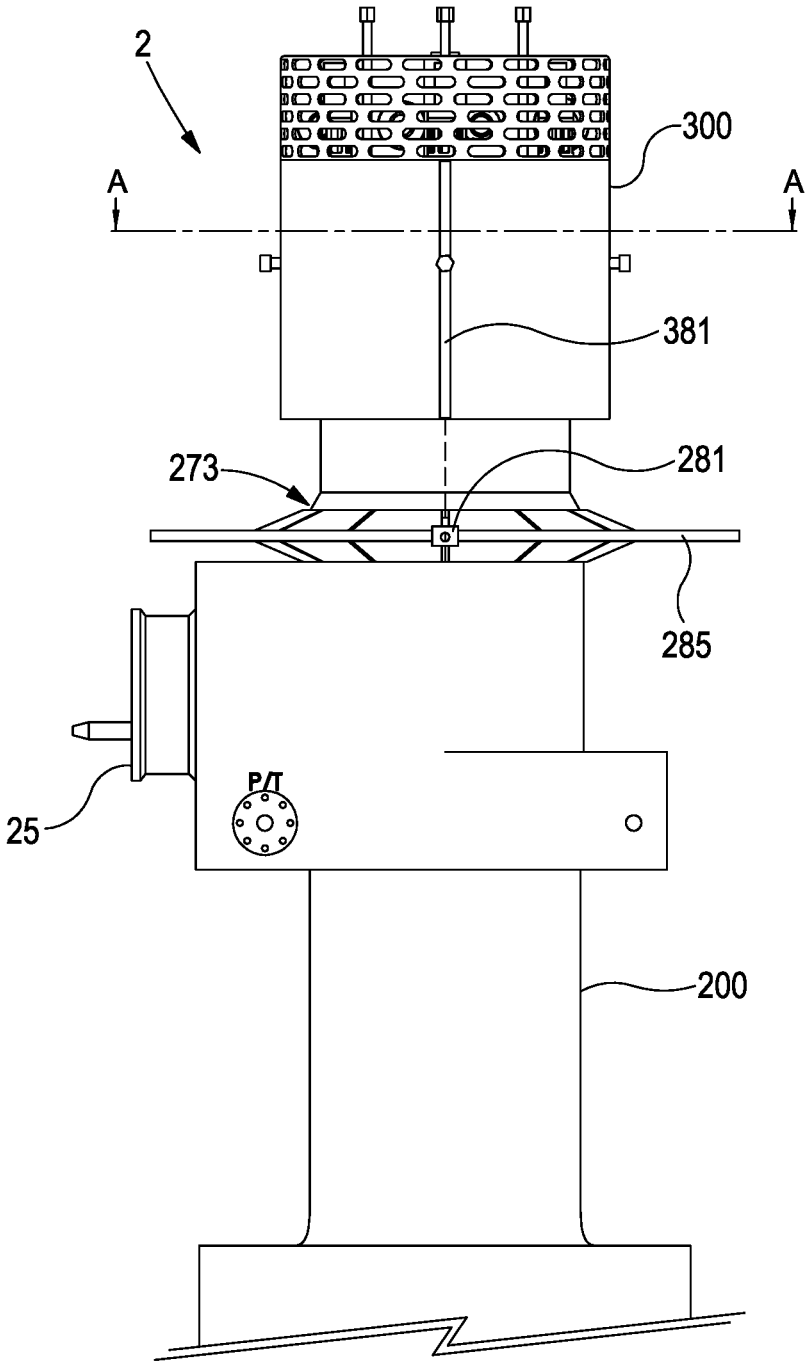
FIG. 13 is an exterior side view of the apparatus of FIG. 12 during installation of the cap in smaller scale.
Figure 14:
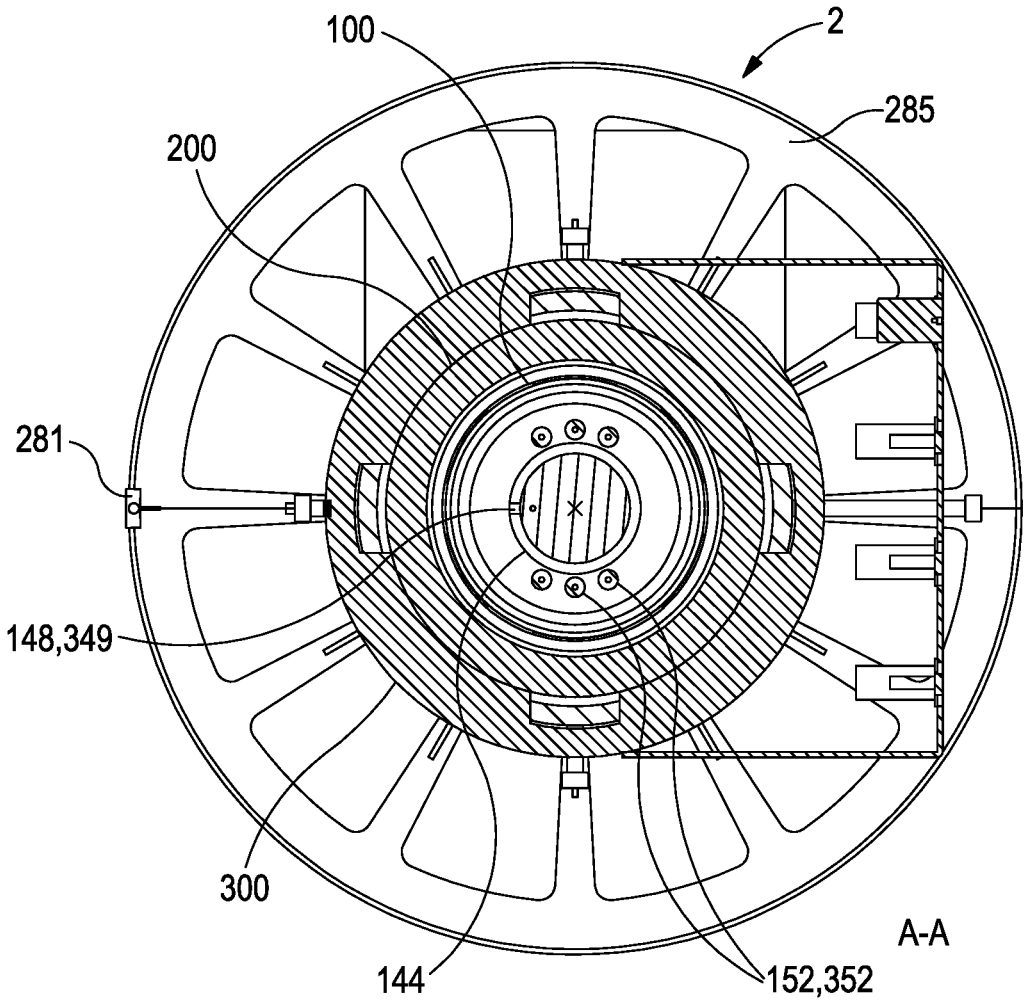
FIG. 14 is top sectional view of the apparatus of FIG. 13 along line A-A, during installation in large scale.

With further reference to FIGS. 12 to 14, features of the apparatus 2 for facilitating the alignment of the cap 300 include a first, rotatable marker 281. The rotatable marker 281 can be rotated about axis X relative to the housing 200 into different rotational orientations, e.g. by manipulation of an underwater manipulator arm, such as an ROV arm or the like. The marker 281 in this example is provided on a slidable ring 285 disposed around a tubular section of the outer housing 200. The slidable ring is rotatably mounted on a shoulder 273 on an outside of the tubular portion of the outer housing 200. Provision of the slidable ring 285 can facilitate handling by the ROV arm for purposes of positioning the marker 281 in position relative to the outer housing 200.

The marker 281 is rotated to a position corresponding to the position of the slot 148 in the sleeve 144 of the tubing hanger 100. A second, marker 381 on the cap 300, in this case a painted vertical stripe on an exterior surface of the cap 300, is lined up with the marker 281 of the rotatable device. The second marker 381 corresponds to the location of the locating member 349.

The connection procedure of the cap 300 includes the following steps to align the cap for connection of the connectors 152, 352:

S1. The tubing hanger 100 is inserted axially into place within the outer housing, its rotational orientation about the axis being generally arbitrary.

S2. Before installing the cap, the location of the slot 148 in the tubing hanger is identified and its rotational position is marked using the marker 281. An ROV or underwater camera is used to visually identify the location of the slot 148 within the outer housing. The marker 281 is rotated by sliding the ring around the housing until the marker 281 is located in a position that corresponds with the identified position of the slot. The marker 281 is then kept in this position relative to the main housing 200.

S3. The cap is prepared for installation with landers 383 extended.

S4. The cap 300 is lowered and landed on an end surface of 240 of the end of the tubular portion of the outer housing 200 such the rollers 284 bear against the end surface 240. FIG. 12 illustrates the rollers on the end surface 240. Locking dogs 363 are retracted during the lowering and landing of the cap so as not to interfere with the tubular end.

S5. The cap 300 is landed generally in arbitrary rotational position about the axis X. The cap 300 is then rotated, rolling on the rollers 384, about the axis X relative to both the tubing hanger 100 and outer housing 200. (The tubing hanger and outer housing are in fixed relationship once the tubing hanger is installed within the outer housing). An ROV or underwater manipulator is used to rotate the cap 300. The cap 300 is rotated into an aligned position where the vertical paint stripe mark 381 on the cap is observed, e.g. through camera on the ROV, to align with the marker 281. In this aligned position, since the marker 381 corresponds to the position of the locating member 349 of the cap that is to be located in the slot 148, the alignment of the markers 281, 381 indicates that the locating member 349 is aligned with the slot 148. In this position also in this example, the connectors 152, 352 are axially aligned, although not yet connected. The aligned position is indicated in the configuration of the system illustrated in FIGS. 12 to 14.

S6. The cap 300 is then lowered further over the end of the outer housing 200 and the locating member 349 enters the slot 148. To do so, the extenders 383 are retracted such that the cap lowers under gravity and subsea pressures. If necessary or in addition, suction is applied inside the main bore to increase the pressure differential to facilitate the lowering process. Chamfered corners on the entrance to the slot 148 can help to correct any small e.g. a few degrees of rotational misalignments of the cap 300 if the alignment is not perfect by lining up the markers 281, 381. Upon further lowering, the connectors 152, 352 are brought together and connect through axial movement of the one with respect to the other. When in the slot 148, the connection of the connectors 152, 352 takes place while the cap is confined to axial translation and rotational movement thus prevented. The axial translation of the cap produces the corresponding axial action for connecting the connectors 152, 352 whereby the male connectors penetrate receiving sockets of the female connectors.

S7. The cap 300 is finally secured to the housing 200 by securing the two sets of locking dogs 163, 363 using corresponding sets of securing pins 364, 394.

Figure 15:
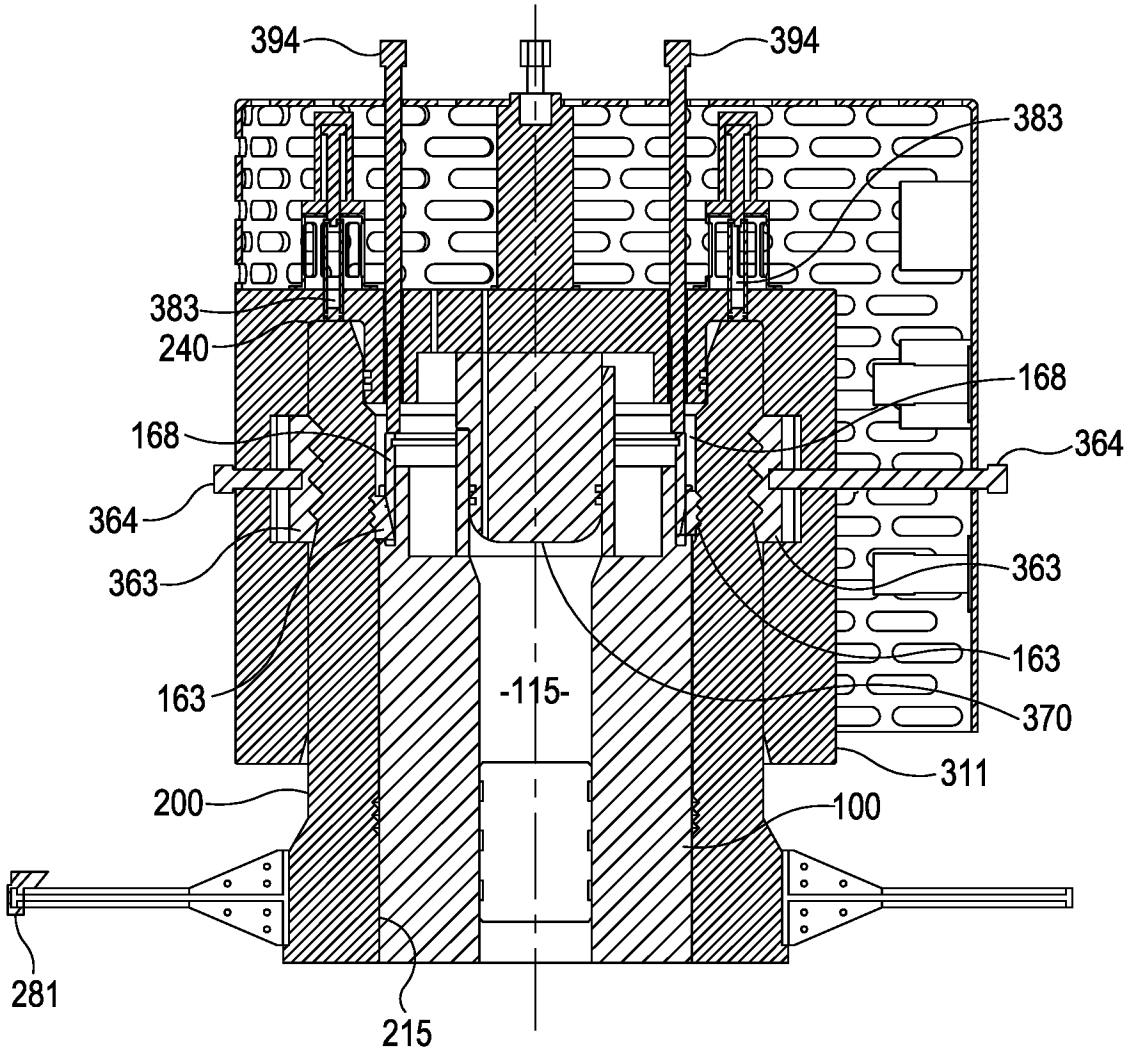
FIG. 15 is a side sectional representation of an upper part of the apparatus of FIGS. 1 and 2 in perpendicular orientation showing a secured configuration in larger scale.
Figure 16:
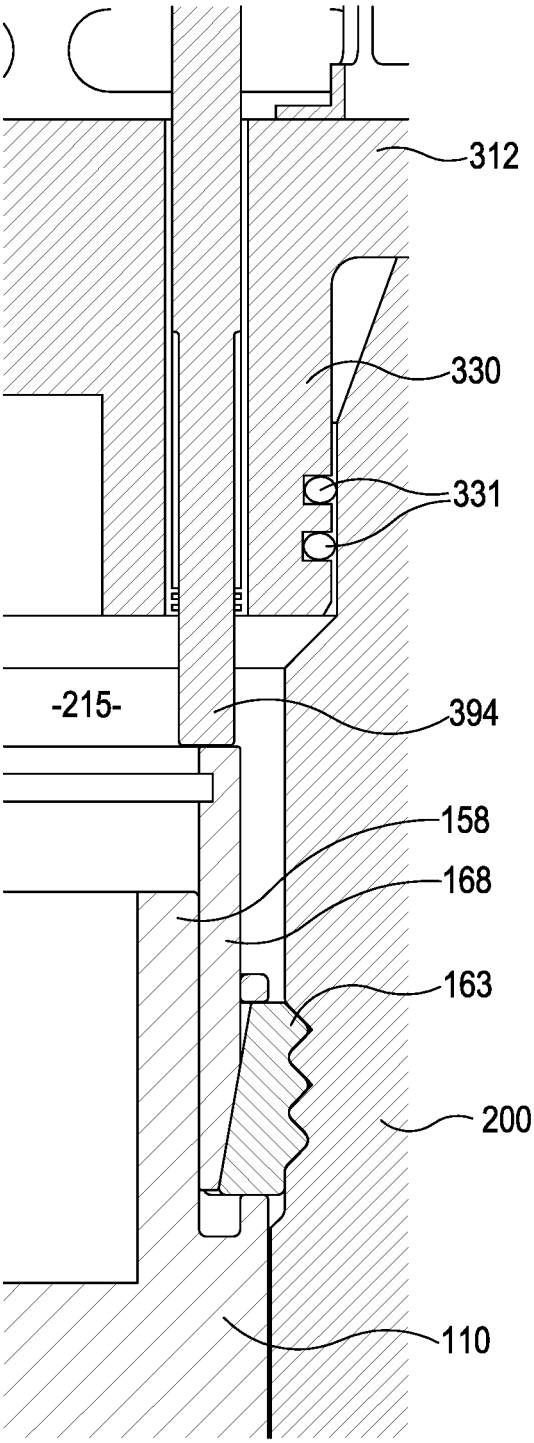
FIG. 16 is a side sectional representation of the circled detail of FIG. 15 in close-up.

In FIGS. 15 and 16 the secured configuration after securing the cap 300 to the housing is exemplified in greater detail. The pins 394 are screwed into position through the end wall 312 so that the ends of the pins 394 penetrate into the bore 215 and secure the locking sleeve 168 so that it cannot work its way upward out of engagement with the locking dogs 163 that act to keep the tubing hanger locked to the outer housing 200. This can avoid vibrations from the production process causing dislodgement.

As can be appreciated, the tubing hanger 100 and cap 300 are arranged concentrically with the bore 215 of the housing 200 such that the central axes X, X', and X" are coincident with one another when assembled together in the completed well.

The services lines through the tubing hanger and cap may provide the downhole equipment or instruments with desired electrical, hydraulic, and/or optical services, such as data, signals, and/or power transmission for operating or communicating with the equipment or instruments.

Figure 17:
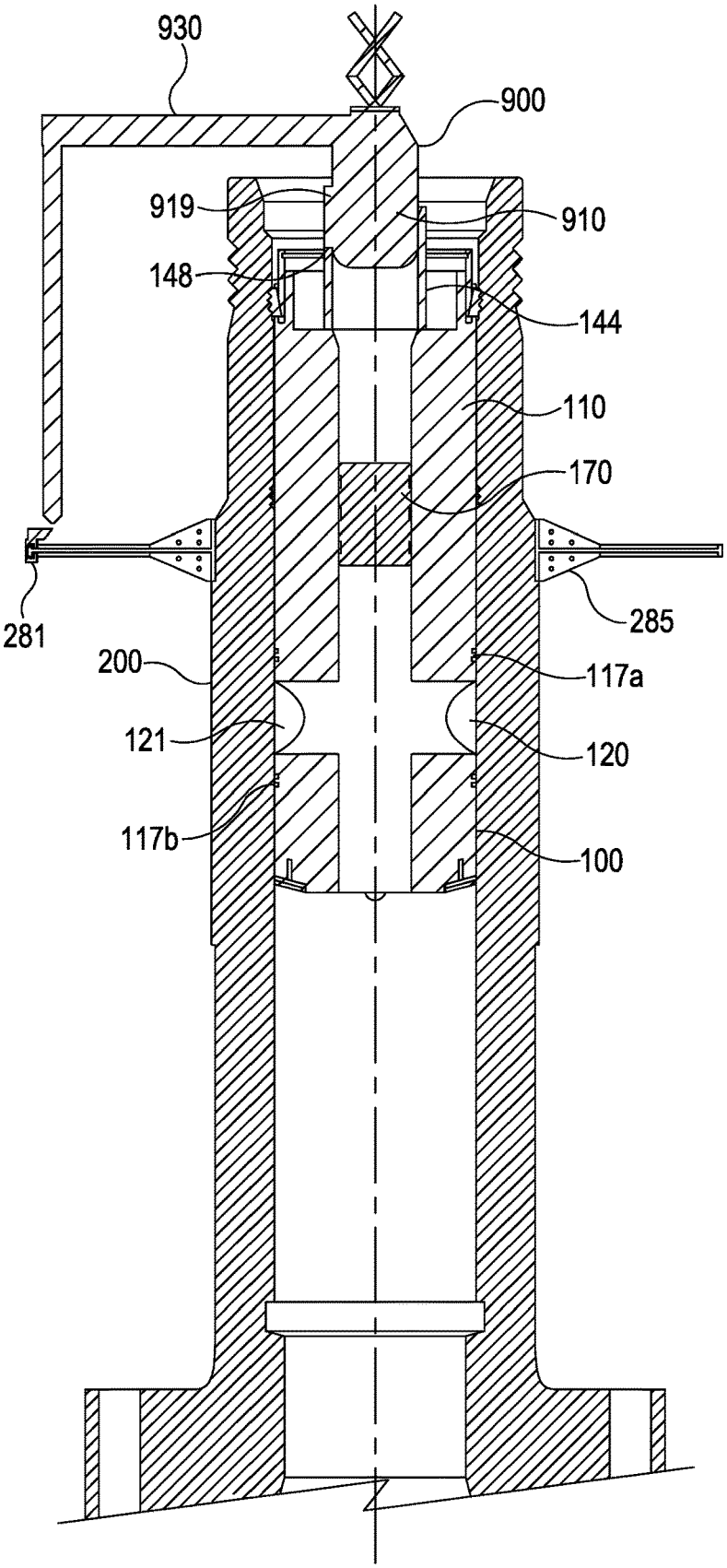
FIG. 17 is side sectional representation of apparatus during an alignment procedure according to another embodiment of the invention.

Turning to FIG. 17, an alternative variant for finding the orientation of the slot 148 of the tubing hanger is carried out by using a jig 900. The jig 900 has a body 910 that fits into the inner end sleeve 144. The body 910 is inserted into the sleeve and then rotated until a locating member 919 on the body 910 locates in the slot 148. A radial cantilever 930 connected to the body 910 projects over the side of the housing 200 at a rotational position corresponding to the location of the slot, and the rotatable marker 281 on the housing 200 is rotated to align with the cantilever 930. This variant may facilitate more accurate and convenient identification of the position of the tubing hanger within the housing 200.

Figure 18:
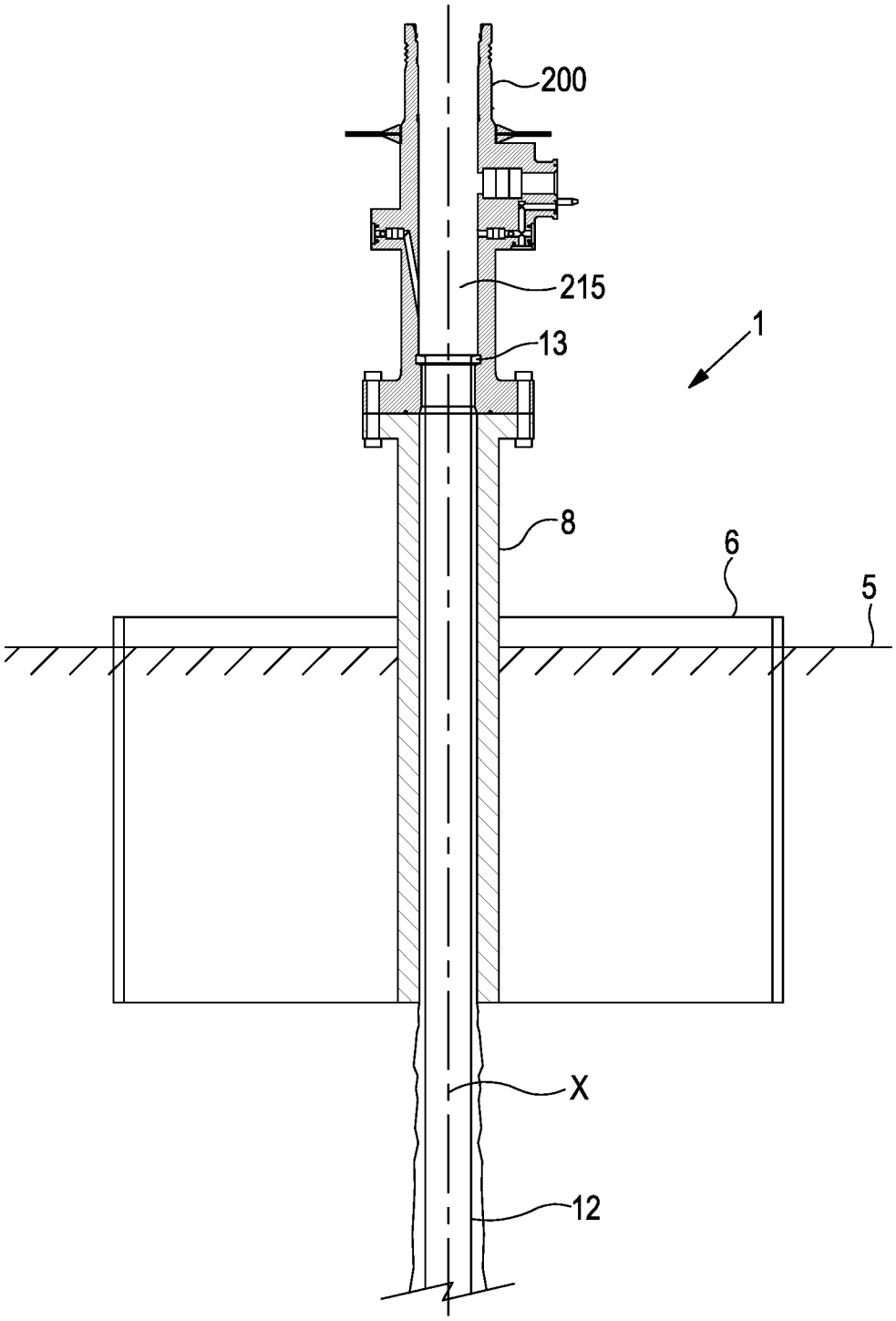
FIG. 18 is a representation of a well prior to installation of the tubing hanger according to an embodiment of the invention.

The examples described above can be employed in a method of constructing and completing a well for production. The method can be understood with reference to FIGS. 18 to 20. In FIG. 18 initially, the main housing 200, spool 8, and foundation 6 are installed. These are installed as a preconnected unit. At the stage indicated in FIG. 18, well construction including drilling and casing has been performed through the connected vertical bores of the main housing 200 and the spool 8. Casing and drill strings access the wellbore 3 through the pipe during various phases of drilling and casing. Surface casing 12 is suspended from a casing hanger (not shown) near a lower end of the housing 200 and cemented in place. The well 1 as indicated in FIG. 18 is ready to receive the upper completion including the tubing hanger. The upper completion is run into the well including the down hole equipment. Hydraulic and electric communication lines from the downhole equipment are clamped in place to the outside of the string of tubing as it is lowered into the wellbore. Near the end of tubing run-in, the tubing hanger 100 is connected to the string, the tubing hanger 100 being the uppermost element of the upper completion. The hydraulic and electric communication lines from the downhole equipment are connected to connectors located on the bottom of the tubing hanger. The tubing hanger 100 is then attached to a running tool (not shown), and the upper completion is then run into the well.

Figure 19:
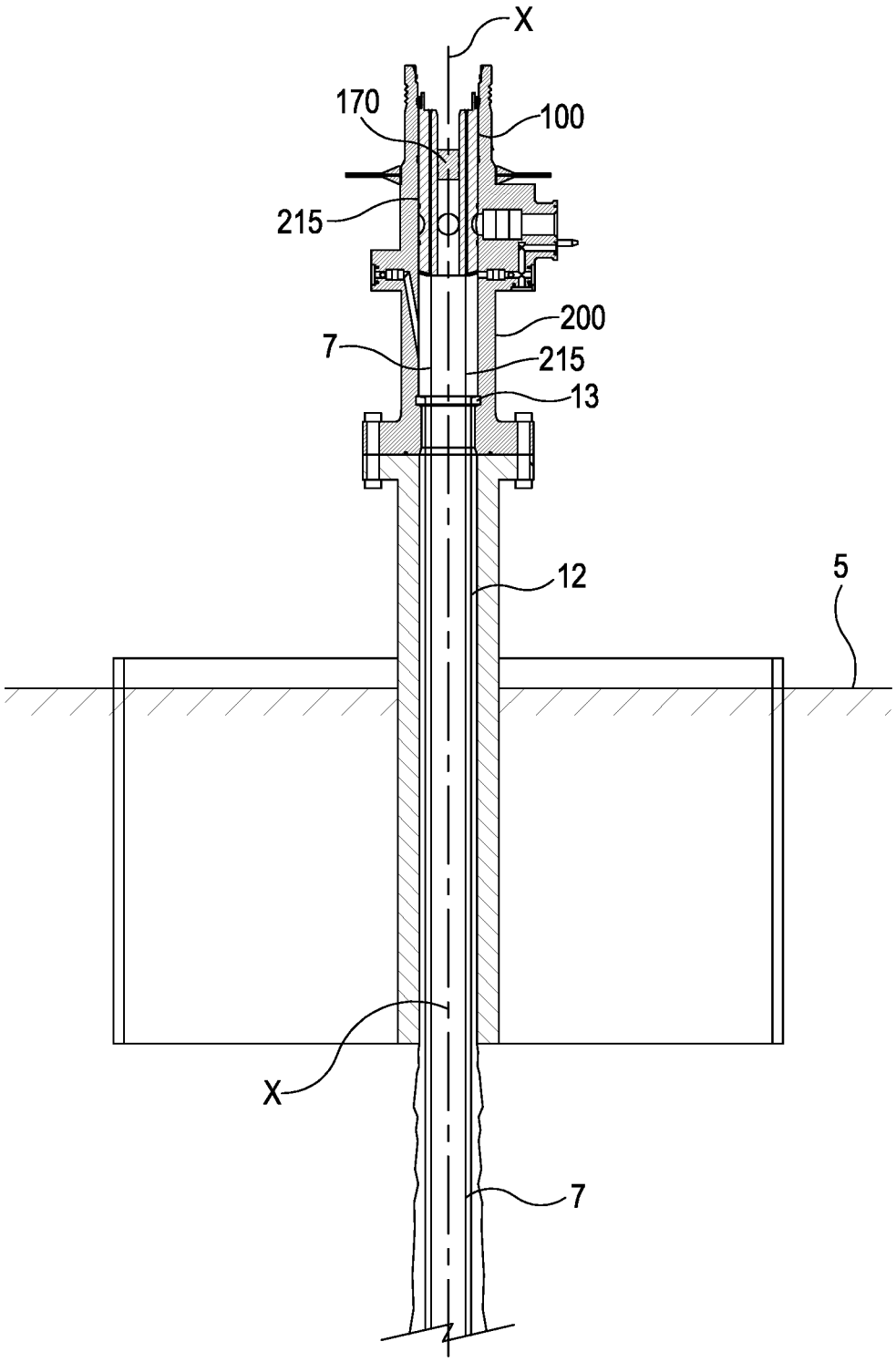
FIG. 19 is a representation of the well of FIG. 18 after installation of the tubing hanger, but before installation of a cap.
Figure 20:
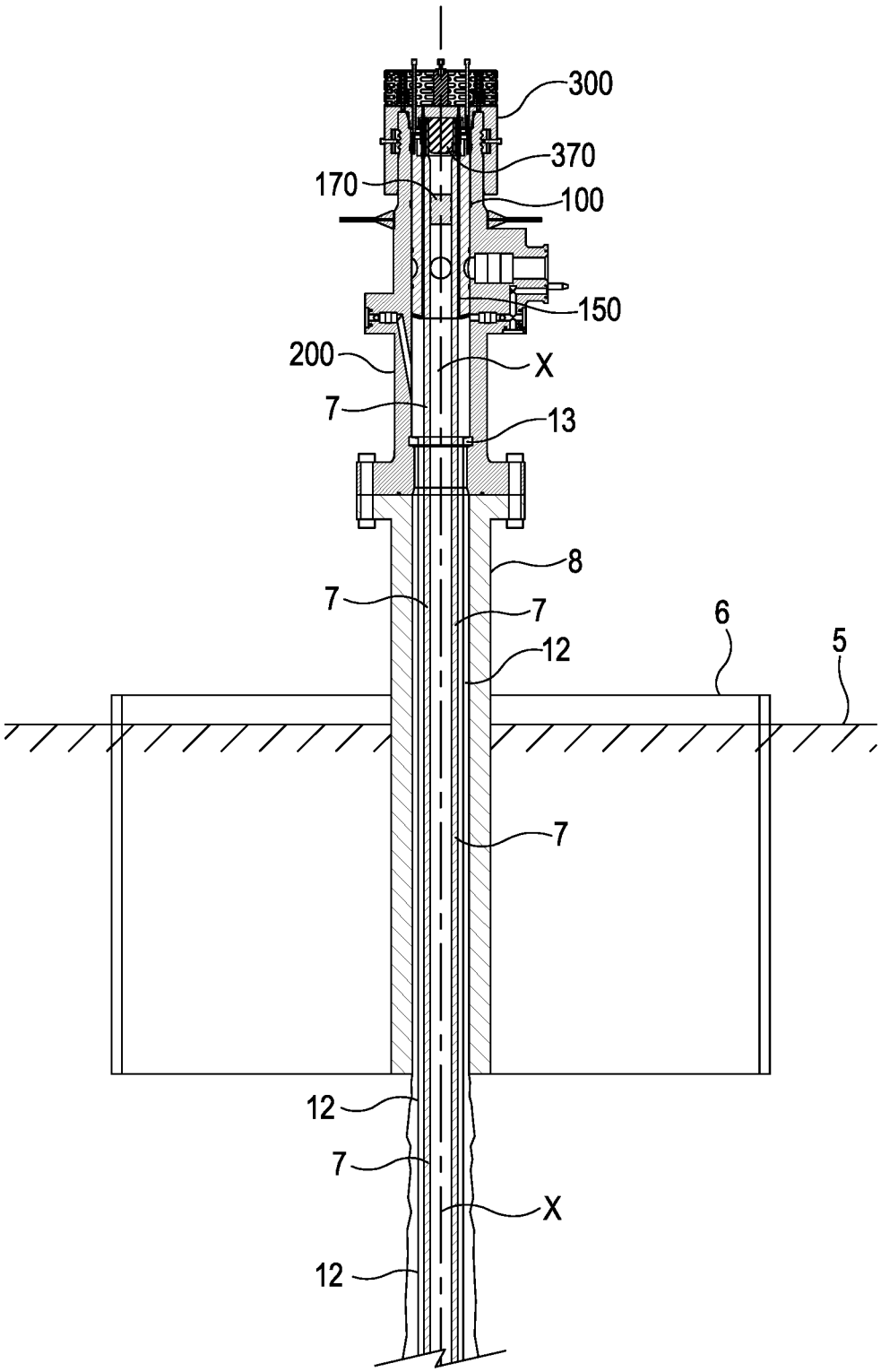
FIG. 20 is a representation of the well of FIGS. 18 and 19 after installation and securing of a cap.

The tubing hanger 100 then lands in the housing 200, seal assemblies are energized, tested, and the tubing hanger 100 is locked into the bore 215 of the outer housing 200, in the position as indicated in FIG. 19.

The running tool is then recovered before an internal barrier plug 170 is installed in the central bore 115 of the tubing hanger 100. The barrier plug 170 is typically a mechanical plug run and installed by a wire line running string. With the plug 170 installed, there are sufficient barriers in the well to allow the drilling BOP (placed on top of the outer housing 200, not shown) to be removed.

The high-pressure cap 300 is then run in open water with a wire or drill pipe down to above the top of the subsea production system. A rough alignment of the cap 300 with respect to the tubing hanger 100 is done, such as described in the examples above, initially by the ROV e.g. by visual inspection of the orientation of the tubing hanger, followed by making a temporary marking outside of the tubular mandrel portion of the housing 200 using marker 285. The high-pressure cap 300 is lowered down over the end of the mandrel portion. The high-pressure cap 300 will initially stop with the landers resting against an end surface 240 of the mandrel portion.

The ROV will now operate to turn the high-pressure cap 300 about axis X until the locating key is aligned with a vertical slot in the end sleeve 144 of the tubing hanger 100. The extenders are retracted allowing the high-pressure cap to travel further down vertically until it lands in its final position. As this final vertical movement takes place, the connectors 152, 352 in the tubing hanger 100 and the high-pressure cap 352 connect and establish the services communication with the external and the down hole equipment.

The high-pressure cap 300 is locked into the housing 200 using the ROV and required pressure tests are carried out in order to verify the sealing capacity of the cap. External jumpers are then installed from the cap to the control module (the control module is in communication with the control room on the platform when the well is commissioned and in production mode).

The examples above can be advantageous in several ways. By use of the non-oriented tubing hanger 100, it is not necessary to build a spiral guide track into the bore of the main housing or outer surface of the tubing hanger itself. This can significantly reduce the total height of the wellhead apparatus while the cap provides for communication through the cap and tubing hanger for communication and control of downhole equipment. The solution can also save valuable diametric space within the outer housing 20, which especially in the approach to well construction and completion depicted in the examples where construction and completion operations take place through the same mandrel used for production through a production wing on the mandrel and connected production flow valve block may be beneficial since it can increase the range of operations and flexibility that may be performed during such construction phases via the housing 200. Axial services line connections are conveniently achieved simply by axial translation of the cap onto the end of the housing 200. The cap 300 has multiple functionalities that can simplify installation and completion procedures for a well. The cap includes seals and a plug for sealing the central conduit of the tubing hanger and sealing against tubular end body, for containing high pressures. The incorporation of the plug is convenient means of providing a second well barrier as part of the cap installation process. Securing pins and locking dogs mechanically block against later life dislodgement of the dogs and the cap under well pressure events. The two-step process of aligning the cap before it is then axially translated for connection of the pins, can prevent against potential damage to the connectors. While the abovementioned securing pins 364, 394 are operated by screw threads, alternative actuation mechanisms, e.g. hydraulic or electric, can be used instead. For example, hydraulic pistons may extend inwardly to engage the same surfaces as the pins 364, 394 for blocking movement of the locking dogs 163, 363.

A number of further variants can be contemplated. Firstly, examples above with reference to production tubing have been described but it can be appreciated that the well can be an injection well and the tubing may alternatively be injection tubing, where fluid is injected into the well taking the same path but in the opposite direction to that of the production fluid through the tubing hanger and tubing.

It is also important to realise that the solution presented herein does not rely on spiral type structures built into the tubing hanger 100 and/or the outer housing 200, not just because of the way that the tubing hanger achieves fluid communication with the wing bore, but also because by running the services lines through the end of the main bore 215 and the cap 300, external side stabs communicating through a side wall of a body such as a valve tree as facilitated by spiral solutions in the prior art can be avoided. Instead of side stabs, the cap can be conveniently rotated to produce the "top end" communication of services without requiring spiral alignment of the tubing hanger. The running tool for the tubing hanger can readily connect to the services connectors 152 on the upper end of the tubing hanger 100. This allows communication through the tubing hanger with the downhole equipment or instruments during run in of the tubing hanger. Moreover, in providing "top end" communication, it can be appreciated that it may not necessarily need to be the cap itself that is oriented to connect connectors. But one can appreciate that another body with an associated connector could be positioned to make up the necessary connection to the tubing hanger services line, and the cap could then be installed in a further step where requirements for handling and alignment of the cap could be relaxed. However, there can be benefits in efficiency in the multi-purpose functionality of the cap including that of orienting and connecting connectors, providing service lines, and plugging the tubing hanger central bore in the same installation process.

It can also be appreciated that the connection of the connectors 152, 352 could in some variants be embodied in different ways. For example, the distance of axial movement required to connect the connectors may be smaller. The slot 148 could in some variants have an angular trajectory around the longitudinal axis in part of the slot, e.g. to facilitate rotational movement of the cap relative to the tubing hanger in a phase of movement prior to respective pairs of connectors 152, 352 engaging one another. In other variants also, the connectors 152, 352 may be arranged in other orientations, not necessarily parallel along the axis as exemplified above. In such other orientations, the connectors may be connected when upon location of the cap and alignment of the cap in the required orientation with respect to the tubing hanger.

Further variants are also envisaged. Instead of the slot 148 being arranged in the sleeve 144 of the tubing hanger, the converse is also possible where the cap includes a sleeve with a guide slot and the tubing hanger has a locating member that is received the guide slot. Furthermore, it should be noted also that the alignment is not required to be achieved by a sleeve and locating members.

The sleeve 144 can be an integrated part of the tubing hanger body, or may be connected to the tubing hanger body. The markers 281, 381 that are aligned do not need to coincide with positions of the slot and the locating member, however, they have a relationship to the slot and locating members such when the markers are aligned, the slot and locating member are aligned as necessary for allowing the further movement and lowering of the cap onto the main housing to connect the connectors.

Although the alignment and rotation of the cap 300 takes place in the above examples while the cap is landed on the end on rollers of the extenders, it can be appreciated that rollers or extenders of this type are not necessarily required, and also the cap may not initially need to rest on the housing 200 during its alignment. For example, in another embodiment, the high-pressure cap 300 is lowered through the sea and initially stops on an external landing arrangement located on the outside of the main housing mandrel, e.g. supported on the seabed or foundation rather than on the foundation 4. In some embodiments, the locating member 349 in the high-pressure cap simultaneously could rest directly on the orientation sleeve 144 located on the upper part of the tubing hanger 100. The locating member 349 may then be rotated about the axis X by manipulation of the ROV until it finds the entrance to the slot at which point the cap is free to move further downward and by virtue of the further movement downward connect the connectors 152, 352.

While the arrangement is illustrated in connection with a mandrel of the tubular housing that is installed on spool 8 and suction anchor foundation 4, it can equally be applied to cap the tubular ends of conventional wellhead mandrels.

Various modifications and improvements may thus be made without departing from the scope of the invention herein described.

The invention claimed is:

1. A method of completing a well, the well having an outer housing which comprises a vertical main bore and a wing bore, an axis extending through the main bore, the method comprising the steps of:

running an upper completion into a wellbore of the well;

locating a tubing hanger of the upper completion in the main bore of the outer housing in an operational position for fluid communication with the wing bore, the tubing hanger including at least one services line that is connected to downhole equipment and/or instrumentation in the wellbore;

connecting at least one further services line to the services line of the tubing hanger, after the tubing hanger has obtained said operational position; and installing a cap on an end of the main bore;

whereby the connected services lines are arranged to communicate at least one service between the tubing hanger and an exterior of the capped well through either or both of: the end of the main bore; and the cap;

wherein the step of installing the cap further comprises:

landing the cap on a landing surface;

rotating the cap about the axis to obtain an aligned position relative to the tubing hanger and/or outer housing; and lowering the cap from the aligned position, thereby connecting the service lines; and wherein lowering the cap comprises axially translating the cap from the aligned position into a position in which the services lines are connected, wherein a guide arrangement comprising a recess, groove, or slot and a locating member which is arranged to be received and travel therein operates to restrict rotation and permit axial translation of the cap relative to the tubing hanger and outer housing in at least part of a trajectory determined by the guide arrangement.

2. The method as claimed in claim 1, wherein the connecting step comprises connecting at least one pair of connectors, one of which is a connector for the services line of the tubing hanger, the other of which is a connector for the further services line.

3. The method as claimed in claim 2, which further comprises rotating the cap about the axis with respect to the tubing hanger to align the connectors of the pair.

4. The method as claimed in claim 2, which further comprises lowering the cap with respect to the tubing hanger to connect the pair of connectors.

5. The method as claimed in claim 4, which further comprises axially translating the one connector with respect to the other to connect the pair of connectors.

6. The method as claimed in claim 1, wherein the cap is rotated on the landing surface on at least one roller.

7. The method as claimed in claim 1, wherein the cap is landed on the landing surface on retractable landers that bear against the landing surface.

8. The method as claimed in claim 1, wherein the step of lowering the cap is performed by retracting a retractable lander.

9. The method as claimed in claim 1, wherein the step of lowering the cap includes applying suction in the main bore.

10. The method as claimed in claim 1, wherein the step of lowering the cap comprises axially translating the cap relative to the outer housing and/or the tubing hanger.

11. The method as claimed in claim 1, wherein the step of lowering the cap comprises moving the cap relative to the tubing hanger and/or outer housing on a trajectory determined by a guide arrangement.

12. The method as claimed in claim 1, which includes locating the locating member in a slot, recess, or groove by rotating the cap on the landing surface until the locating member locates in the slot by gravity and/or subsea pressure.

13. The method as claimed in claim 1, which further comprises:

marking a rotational orientation of the tubing hanger within the outer housing using a marker;

rotating the cap about the axis to align a marker on the cap with the marker used to mark the orientation of the tubing hanger, thereby obtaining an aligned position of the cap with respect to the tubing hanger.

14. The method as claimed in claim 13, which includes using a remote-operated underwater manipulator to rotate the marker to mark the rotational orientation of the tubing hanger and rotate the cap.

15. The method as claimed in claim 13, wherein the rotational orientation of the tubing hanger is marked before landing or before rotating the cap on the surface.

16. A method as claimed in claim 1, which includes installing at least one intermediate body between the cap and the tubing hanger.

17. A cap for a main bore of an outer housing for a well, the main bore being arranged to receive a tubing hanger, the tubing hanger including a services line, the cap including at least one further services line to be connected to the services line of the tubing hanger for communicating services through the cap between the tubing hanger and an exterior of the cap;

wherein the cap further comprises at least one retractable lander arranged to be retractable to permit the cap to be moved into a fitted position on the end of the tubular portion of the outer housing; and wherein the lander has at least one roller for bearing against a landing surface on the outer housing or the tubing hanger for facilitating rotation of the cap on the landing surface into an aligned position in which the cap is oriented with respect to the tubing hanger for permitting the cap to be axially translated to connect services line portions.

18. A cap for a main bore of an outer housing for a well, the main bore being arranged to receive a tubing hanger, the tubing hanger including a services line, the cap including at least one further services line to be connected to the services line of the tubing hanger for communicating services through the cap between the tubing hanger and an exterior of the cap; and further comprising securing means comprises at least one pin arranged to axially protrude into the cap to secure a locking sleeve on the tubing hanger, the locking sleeve forming a wedge between a surface of the tubing hanger and locking dogs.

19. A method of completing a well, the well having an outer housing which comprises a vertical main bore and a wing bore, an axis extending through the main bore, the method comprising the steps of:

running an upper completion into a wellbore of the well;

locating a tubing hanger of the upper completion in the main bore of the outer housing in an operational position for fluid communication with the wing bore, the tubing hanger including at least one services line that is connected to downhole equipment and/or instrumentation in the wellbore;

connecting at least one further services line to the services line of the tubing hanger, after the tubing hanger has obtained said operational position;

installing a cap on an end of the main bore; and installing at least one intermediate body between the cap and the tubing hanger;

whereby the connected services lines are arranged to communicate at least one service between the tubing hanger and an exterior of the capped well through either or both of: the end of the main bore; and the cap;

wherein the step of installing the cap further comprises:

landing the intermediate body on a landing surface;

rotating the intermediate body about the axis to obtain an aligned position relative to the tubing hanger and/or outer housing; and lowering the intermediate body from the aligned position, thereby connecting the service lines; and wherein lowering the intermediate body comprises axially translating the intermediate body from the aligned position into a position in which the services lines are connected, wherein a guide arrangement comprising a recess, groove, or slot and a locating member which is arranged to be received and travel therein operates to restrict rotation and permit axial translation of the intermediate body relative to the tubing hanger and outer housing in at least part of a trajectory determined by the guide arrangement.

20. A method of completing a well, the well having an outer housing which comprises a vertical main bore and a wing bore, an axis extending through the main bore, the method comprising the steps of:

running an upper completion into a wellbore of the well;

locating a tubing hanger of the upper completion in the main bore of the outer housing in an operational position for fluid communication with the wing bore, the tubing hanger including at least one services line that is connected to downhole equipment and/or instrumentation in the wellbore;

connecting at least one further services line to the services line of the tubing hanger, after the tubing hanger has obtained said operational position; and installing a cap on an end of the main bore;

whereby the connected services lines are arranged to communicate at least one service between the tubing hanger and an exterior of the capped well through either or both of: the end of the main bore; and the cap;

wherein the step of installing the cap further comprises:

landing the cap on a landing surface;

rotating the cap about the axis to obtain an aligned position relative to the tubing hanger and/or outer housing; and lowering the cap from the aligned position, thereby connecting the service lines; and wherein the cap is rotated on the landing surface on at least one roller.

21. A method of completing a well, the well having an outer housing which comprises a vertical main bore and a wing bore, an axis extending through the main bore, the method comprising the steps of:

running an upper completion into a wellbore of the well;

locating a tubing hanger of the upper completion in the main bore of the outer housing in an operational position for fluid communication with the wing bore, the tubing hanger including at least one services line that is connected to downhole equipment and/or instrumentation in the wellbore;

connecting at least one further services line to the services line of the tubing hanger, after the tubing hanger has obtained said operational position; and installing a cap on an end of the main bore;

installing at least one intermediate body between the cap and the tubing hanger;

whereby the connected services lines are arranged to communicate at least one service between the tubing hanger and an exterior of the capped well through either or both of: the end of the main bore; and the cap;

wherein the step of installing the intermediate body further comprises:

landing the intermediate body on a landing surface;

rotating the intermediate body about the axis to obtain an aligned position relative to the tubing hanger and/or outer housing; and lowering the intermediate body from the aligned position, thereby connecting the service lines; and wherein the intermediate body is rotated on the landing surface on at least one roller.

* * * * *